US006089493A

United States Patent [19]

Moore

[11] Patent Number: 6,089,493

[45] Date of Patent: Jul. 18, 2000

[54] WIRE WRAPPING MACHINE

[76] Inventor: Richard G. Moore, 3722 SW. 82nd St., Gainesville, Fla. 32608

[21] Appl. No.: 09/255,132

[22] Filed: Feb. 19, 1999

[51] Int. Cl.[7] ..... B65H 54/64

[52] U.S. Cl. ..... 242/438.1; 242/418.1

[58] Field of Search ..... 242/438, 438.1, 242/441, 419.4, 418.1

[56] References Cited

U.S. PATENT DOCUMENTS

| | | | |
|---|---|---|---|
| 22,762 | 6/1859 | Crom | 242/438.1 X |
| 1,304,565 | 5/1919 | Henderson | 242/418.1 X |
| 2,345,765 | 4/1944 | Michel | 242/418.1 X |
| 2,375,921 | 5/1945 | Hirsh | 242/438 X |
| 3,052,419 | 9/1962 | Huck | 242/438 |
| 3,338,527 | 8/1967 | Chidzey | 242/438 |
| 3,379,385 | 4/1968 | Osweiler | 242/438 |
| 3,540,674 | 11/1970 | Okamura | 242/419.4 X |
| 3,682,410 | 8/1972 | Rinearson . | |
| 3,770,219 | 11/1973 | Hickman . | |
| 3,773,270 | 11/1973 | Brandestini | 242/438.1 |
| 3,822,167 | 7/1974 | Piola | 242/438.1 X |
| 3,892,367 | 7/1975 | Dykmans . | |
| 3,912,181 | 10/1975 | Mullendore . | |
| 4,002,304 | 1/1977 | Peszeszer . | |
| 4,059,238 | 11/1977 | Vogt . | |
| 4,541,887 | 9/1985 | Carter | 242/438 X |
| 4,659,033 | 4/1987 | Bush et al. | 242/438.1 |
| 4,801,103 | 1/1989 | Bush et al. . | |
| 4,826,091 | 5/1989 | Legatos et al. | 242/438.1 |
| 5,590,497 | 1/1997 | Moore . | |

FOREIGN PATENT DOCUMENTS

| | | | |
|---|---|---|---|
| 464082 | 6/1953 | Canada | 242/438 |
| 358144042 | 8/1983 | Japan | 242/419.4 |
| 360046753 | 3/1985 | Japan | 242/438 |
| 363008170 | 1/1988 | Japan | 242/438.1 |

*Primary Examiner*—Donald P. Walsh
*Assistant Examiner*—Emmanuel M. Marcelo
*Attorney, Agent, or Firm*—Julian C. Renfro, Esq.

[57] ABSTRACT

A mobile wire wrapping machine adapted for wrapping wire under tension around a stationary, generally circular object of large size during substantially continuous travel of the machine around such object. This machine contains a supply of wire utilized in conjunction with a wire tensioning assembly through which the wire passes, with the wire tensioning assembly serving to create a substantial amount of tension in the wire as it passes therethrough, to thereafter be wrapped around the large object. My novel machine utilizes a tension indicating device, which advantageously involves a weight mounted for motion in a direction such that its position is influenced by gravity. The position of the movably mounted weight serves as a reflection of the amount of tension in the wire, and movement of the weight during operation of the machine, provides a conspicuous indication, on a substantially continuous basis, of any changes in tension in the wire. This tension indicating device may be utilized in connection with an arrangement operatively associated with the wire tensioning assembly, for modifying the tension in the wire, so that the wire being wrapped around the large stationary object will be automatically maintained at a consistent tension. In accordance with one embodiment of this invention, the movably mounted weight is suspended by a pulley arrangement, whereas in accordance with another arrangement, the weight is mounted in an adjustable manner on a balance beam, with motion of the balance beam during operation of the machine being about a balance point.

29 Claims, 10 Drawing Sheets

FIG 3
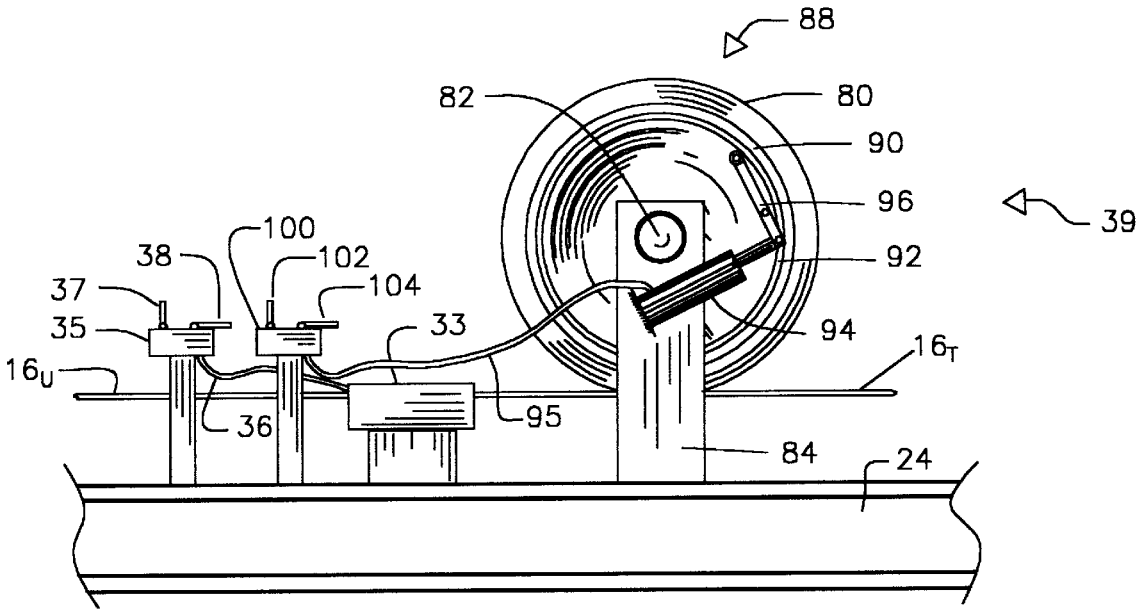
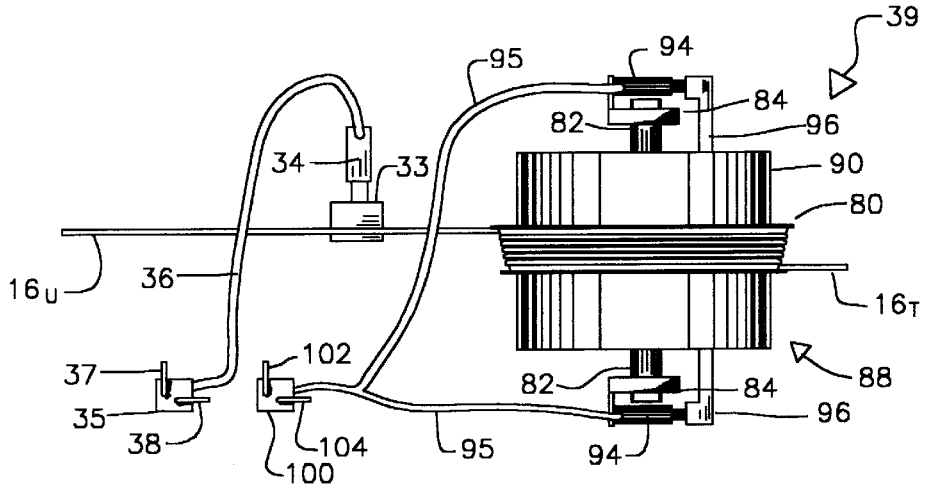
FIG 3a

FIG 5
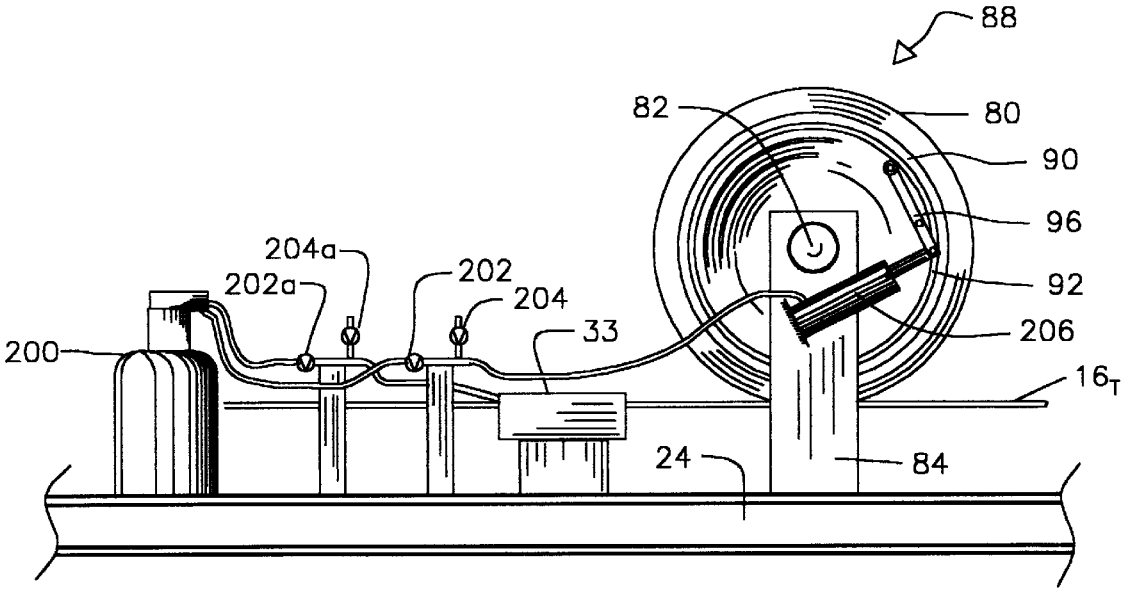
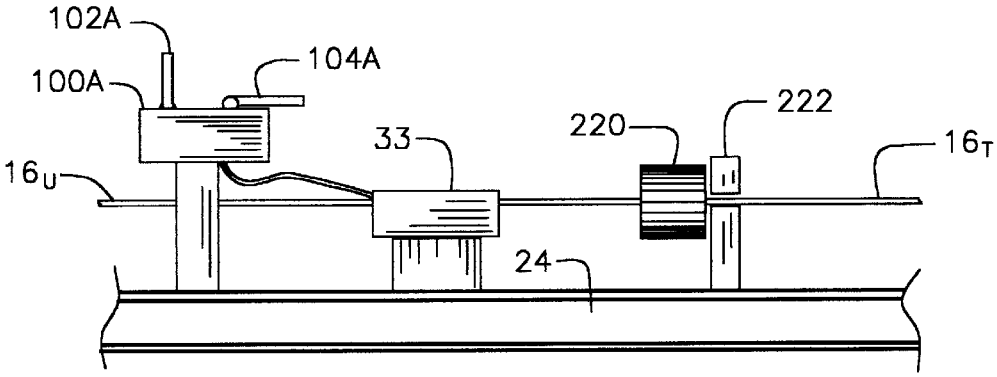
FIG 8

FIG 9a
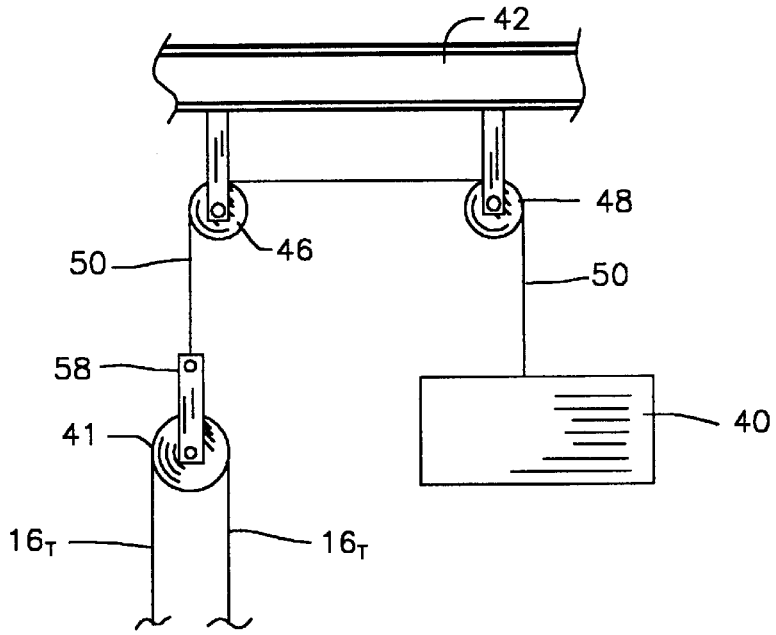
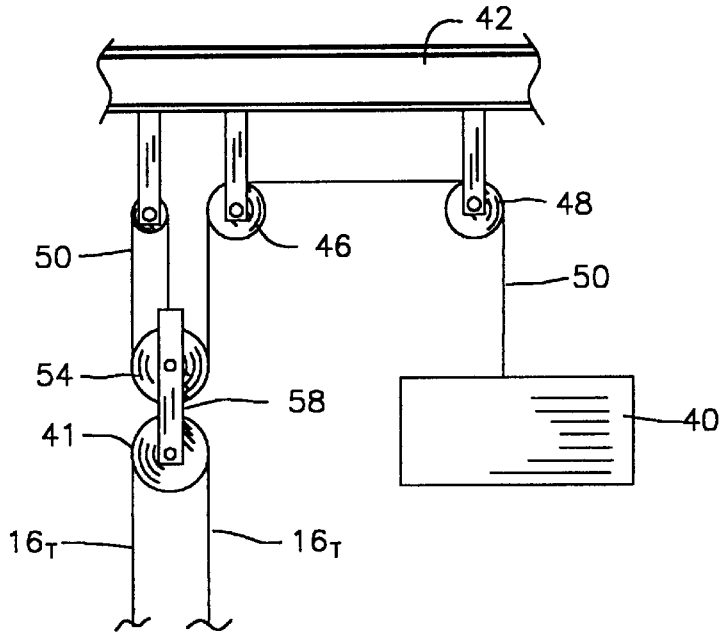
FIG 9b

WIRE WRAPPING MACHINE

BACKGROUND OF THE INVENTION

It has long been known that the strength of a circular concrete tank can be substantially increased by wrapping the tank with many turns of flexible, high strength wire.

There are basically two types of wire wrapping machines in use today. One of these types of machines is commonly referred to as wall hung. Although that type of machine is not the subject of this invention, it nevertheless is appropriate to mention that a machine of this first type is suspended from the top of the tank. During wire wrapping of the tank, the top of the wall of the tank is utilized as support, with this type of machine, also known as a wire guide, moving in a circle around the tank for numerous turns as the tank is being wrapped.

These devices are typically propelled by a chain that is wrapped around the structure. Although accurate, these machines are typically very slow, not only in speed of travel around the structure, but also time is consumed at the time the operator must effect a changeover from one roll of wire to the next. In addition, these wall hung machines are very expensive to own, it is reported that a new one costs in the neighborhood of $130,000.00. Furthermore, in addition to being expensive, these machines are complex to operate and require the stocking of replacement parts of a specialty nature.

Not only is highly skilled and therefore expensive labor involved, but also these wall hung machines require a long set up time. For example, it would be correct to say that on a smaller size tank, a wire wrapping machine that travels on the ground surface around the tank can be set up, the pre-stressed wire wrapped around the structure, and thereafter dismounted before the wall hung machine can ever be set up and placed in operation.

Although many patents have been granted on wall hung machines, it should be sufficient to mention that the Bush et al Pat. No. 4,801,103 which issued Jan. 31, 1989 exemplifies this type of device.

A different type of machine for achieving basically the same result is the so-called ground running machine, with this type of machine being the subject of the present invention. A typical machine of this type consists of a platform, a prime mover or another type of propulsion, a wire roll, wire stressing assembly, tension gauge, and payoff wheel. The machine is towed around the tank a large number of times, with each revolution of the machine serving to place another turn of wire around the tank. These turns are sometimes referred to as wraps of wire.

In order to meaningfully increase the strength of the tank being wrapped, it is necessary to maintain a substantial tension in the wire. For this reason, the wire leaving the wire roll thereafter passes through a wire stressing assembly used to assure that a proper tension will be provided to the wire as it is being wrapped around the tank. Hydraulic pressure is typically utilized for applying a substantial force to a slipbrake operatively associated with the wire stressing assembly. A hydraulic pump under the control of the operator makes it possible for the hydraulic pressure to the wire stressing assembly to be altered as necessary in order to maintain a proper and consistent tension in the wire. In some instances pneumatically operated components could be utilized instead of hydraulically powered components.

It is customary to provide a gauge placed for easy viewing by the operator so that he can ascertain the tension of the wire being wrapped around the large structure. The operator adjusts the pressure applied by the slipbrake by increasing or decreasing the hydraulic pressure, which causes the slipbrake to increase or decrease the tension in the wire. The gauge viewed by the operator typically is equipped with a needle, with this needle often varying rapidly because the ground surface over which the machine is traveling is usually not perfect and uniform. Because of the non-uniformity of the roadway circling the tank, often accompanied by some variation in speed of the towing vehicle, the needle of the gauge frequently reflects an undesirable variation in wire tension, which may run as high as 10%.

Typically the wire wrapping procedure starts by securing an end of the wire on the roll, threading this end of the wire through the machine, and then attaching it to the structure of the circular prestressed concrete tank. Usually a bolt is drilled into the wall of the tank with the end of the wire attached to the bolt. In most instances, the wire wrapping procedure commences at the bottom of the tank, with the wrap proceeding in a consistent, helical manner toward the top.

It is of interest to note that there are two sizes of wire customarily used, with one of these being an 8 gauge wire (0.162" in diameter), which is typically tensioned at 3,000 pounds.

Also used is a somewhat larger 6 gauge wire (0.192" diameter), that is typically tensioned at 4,250 pounds. As is known, the breaking strength of wire is 60% above the normal operating tension.

A roll of wire will weigh between 600 pounds and 2,000 pounds, depending on availability and preference. Approximately 13 lineal feet of 8 gauge wire weighs one pound, whereas approximately 9 lineal feet of 6 gauge wire weighs one pound. From this it can be seen that the capacity of a roll of wire can be readily calculated and generally speaking, the typical roll of wire will enable a tank to be wrapped for 20 to 60 turns, depending on the size of the tank and the size the roll of wire.

It should be mentioned in passing that in some instances it is desirable for more than one layer of wire to be placed on the structure. After the first layer has been wrapped, it is typical to apply a layer of concrete over this first layer in order to encapsulate the wire. Thereafter a second wire wrap may be applied to the structure. Although it is possible with the present equipment to wrap from the upper part of the tank downwardly, it is typical to start again at the bottom of the tank and then wrap in an upward manner.

The wire unrolled off of the roll of wire passes through a pretensioner, which may take the form of two blocks of steel utilized in conjunction with an adjustable hydraulic cylinder, with the wire extending between these two blocks. The hydraulic cylinder enables the operator to select the amount of force with which the blocks of steel are caused to be moved together, with the squeezing of the wire that passes between the two pieces of steel creating a substantial amount of friction and a desirable amount of initial tension in the wire.

The wire is then wrapped around a rotatable component known as a capstan for a suitable number of times, such as seven times, with the wire then passing over a nearby payoff wheel before being wrapped around the tank. It is customary to travel around the tank in what may be regarded as a clockwise motion, but this is of course not a firm requirement. Once the wrapping has started, it is understood that the wrapping will proceed continuously around the tank until almost all the wire on the roll has been expended. The machine is then stopped and the end of the wire is clamped.

A special clamp, well known in the industry, is used for securely fastening wires, usually two, together. The type of clamp I prefer involves a pair of similarly sized plates, each provided with three or more spaced parallel grooves. One of these plates is inserted under two of the wires previously wrapped upon the tank, with those wires residing in the grooves of that plate. Then the second plate is placed atop the first plate, with the same wires residing in the grooves of the top plate, at which time the plates are bolted tightly together. When the tension is let off of the now-expended roll, the clamp tightly maintains the tension of the wires previously placed. This type of clamp serves the additional purpose of preventing the entire structure from unwrapping in the event that a break in the wire occurs.

To be noted in passing is the fact that in the event of a break, the wire will become slack only as far back as the previous clamp. It then becomes necessary to remove all the slack wire and throw it away, with the wrapping procedure to start again from the last point where the wire was tight.

When the new roll of wire has been placed in the operational location, the end of this new roll is then made available, with the two ends of the wires being spliced together. This is typically accomplished by the use of a spiral splice that is well known in the industry, although it is always possible to weld the ends of the two wire together. It is usually preferable to use a splice because it is simple, quick, easy and effective.

After the ends of the wires have been secured together, the wire wrapping procedure starts up again and continues until the next roll has been fully expended or nearly expended, with another roll then being added and the procedure continued until the structure has been fully wrapped. On a larger size structure, this may require the utilization of over 100 miles of properly tensioned wire.

It is to be noted that a skilled operator of this type of machine can bring about the tensioning of the wire to within 5% of the desired tension reading by carefully watching the fluctuations of the needle utilized to indicate wire tension. Typically the needle will fluctuate from the upper limit to the lower limit about once every two seconds. Despite the skill of the operator and his conscientious efforts to carefully control wire tension, one of the problems of this arrangement is that the tension gauge is not mounted and calibrated to accurately read the tension in the wire. Typically the tension gauge will read about 80% to 35% of the actual tension in the wire. This causes problems inasmuch as the operator has to compensate for this inadequacy by conjecturing as to the actual tension in the wire as he notes the tension shown on the tension gauge.

Still another problem is involved in the fact that when the wire is being wrapped around a relatively low part of the structure, the gauge will read higher than when the wire is being applied to the upper portion of the structure, this being true despite the fact that in both instances, the actual wire tension is the same.

To compensate for the difference between the tension shown on the tension gauge and the actual wire tension, it has been necessary, in accordance with known prior art procedures, for the workmen to take certain steps in order to assure that the tension on the structure is per design.

A first of these known procedures involves slopping the operation periodically and measuring actual wire tension on the structure. To accomplish this, a portion of the wire is pulled off of the structure and a special gauge is placed on the wire that will show the tension in the wire. This type of gauge is called a tensiometer or stressometer and is quite familiar to those working in this field. This procedure is known as "reading the wire." Once the actual tension of the wire on the wall has been read, this information is relayed to the operator. This enables the operator to calibrate his equipment, making an adjustment in hydraulic pressure, either up or down, in order to assure that the wire tension on the wall will be consistent with a desired value.

A second of the well known procedures to which the workmen may resort in an effort to assure proper and consistent wire tension involves measuring and recording the tension in each wire on the wall. The workmen will pick one point on the wall that is typical and they will read and log the tension in each wire on the wall at that location. The workmen will then add up the tension in these wires and determine if additional wire needs to be placed on the wall. If the total tension is below design, then additional wraps will be authorized.

Although these procedures have proven effective over the years, considerable improvement is needed, particularly in view of the fact that it is expensive in terms of labor and time to have to stop the wrapping procedure in order to read the wires and log them. In addition, it is quite expensive in terms of labor, time and materials should it become necessary to add more wire wraps to the tank to compensate for low tension in the already-installed wires. Furthermore, these prior art procedures involve a lack of engineering accuracy, which designers find quite undesirable.

In addition to the foregoing, there is always the possibility that a tank will be placed in service with undertensioned wires as a consequence of improper workmanship combined with mathematical errors.

It was in an effort to overcome these disadvantages of the invention is designed to operate on the ground and to travel numerous times around the periphery of the tank. For example, this machine may travel at a speed varying between a slow speed of 3 mph and a fast speed of 15 mph during the wrapping procedure.

This invention may involve a wheeled platform and a means for propelling it over the ground, this typically being a prime mover. Operatively mounted on the platform is a roll of wire representing the wire supply, a wire tensioning assembly, and a payoff wheel.

Of particular consequence to this invention is the utilization of a frame from which a weight of substantial size can be movably suspended for motion about an operating point. This weight serves in accordance with this invention as a tension indicating means and may in accordance with a principal embodiment of this invention, be suspended for vertical travel to an extent of approximately six feet, although if for some reason necessary, the weight could be arranged to travel up and down at an angle to the vertical.

In accordance with another embodiment of this invention, the weight may be mounted upon a balance beam. As will later be appreciated to a fuller extent, in each of these embodiments the weight is mounted for motion in a direction such that its position is influenced by gravity. The motion of the movably mounted weight serves in each embodiment as a reflection of the amount of tension in the wire and provides, during operation of the machine, a conspicuous indication, on a substantially continuous basis, of any changes in tension in the wire.

With regard to the principal embodiment of this invention, after the wire leaving the roll has been tensioned and before it gets to the tank, the path of the wire is deviated such that it passes around a suitable pulley, known as a wire deflection wheel. This pulley is operatively connected to the weight and is positioned on the apex of this deviation or deflection. It is usually preferable for the cable and pulleys that connect the weight to the wire deflection wheel be configured so that the weight will be equal to the desired tension of the wire. Therefore, if for example an 8 gauge wire is being installed on the tank, it would be typical to utilize a 3,000 pound weight therewith.

I am not to be limited to any one pulley arrangement, for in some instances it may be desirable to use a pulley arrangement such that the weight equals twice the tension in the wire, whereas in other instances the pulley arrangement may be such that the weight may equal two-thirds of the desired tension in the pulley.

It has been found convenient to create a weight of the proper size by the use of steel ingots, and to this end it is preferable to utilize a basket operatively attached to the aforementioned pulley, such as by the use of a relatively short cable. These ingots for example may be 4½" square and 3' long, weighing approximately 200 pounds each. Therefore to create a 3,000 pound weight, 15 ingots may be stacked in the basket. These are approximate numbers, however, and the aggregate of all the ingots are weighed to obtain the desired weight.

Assuming for the moment that the wire being applied to the tank extends horizontally toward the tank, this wire passes over the pulley associated with the basket containing the ingots. With an increase in tension of the wire, this causes a force on the pulley, which in turn causes the weight to be lifted. Gravity acts in a favorable way in this instance inasmuch as in order for the weight to be lifted, there will need to be 3,000 pounds of tension in the wire. It is to be understood that in accordance with the above-described arrangement, a 3,000 pound weight will simply not be lifted if there is only 2,997 pounds of tension in the wire.

In the operation of this device, the operator adjusts the output of a pressure-applying device, such as a hydraulic pump or pneumatic pump so as to increase the tension in the wire via the slipbrake until the weight moves up from its lowermost position. When the preferred pulley arrangement is used, and when a 3,000 pound weight has been caused to move off of its resting position, there will necessarily be 3,000 pounds of tension in the wire. As the weight moves up and reaches a mid-point in the travel, known as the operating position, the operator continues to adjust the pressure-applying device, such as a hydraulic pump or a pneumatic pump until the weight reaches a steady-state condition in the mid position of its travel.

Instead of watching a gauge in accordance with the teachings of the prior art, the operator, in accordance with the principal embodiment of this invention, observes the position of the movably mounted weight. In order to keep the weight at or near its desired operating position, the operator either increases or decreases the pressure output of the hydraulic or pneumatic pump in order to keep the weight in a constant steady state condition.

If the weight goes up, this is because the tension in the wire has for one reason or another been increased. This fact will be immediately apparent to the operator, who will let off a little bit on the tension by manipulating a pressure relief valve associated with the hydraulic or pneumatic pump. This will cause the weight to drop down slightly and in this way the operator will be able to readily reestablish the desired operating position for the weight.

As long as a weight of carefully ascertained size is suspended at a steady state condition, the precise tension in the wire extending over to the tank is achieved. As should be obvious, this tension in the wire selected for a given set of conditions can easily be adjusted to a predetermined extent by merely adjusting the weight in the basket.

It is to be noted that certain problems necessarily occur with this type of wire wrapping, the most common of which involve bumps or irregularities in the road, with these serving, quite unfortunately, to affect the tension in the wire. An earthen roadway is the most economical roadway to use, but this type of roadway may get bumpy, particularly when the prime mover is traveling around the tank hundreds of times. One of the numerous advantages of the instant invention is that when an increase in wire tension occurs due to a bump, the weight raises to absorb the effect of this bump, with the tension in the wire remaining the same. Alternatively, if the effect of the bump was to cause a momentary lowering of the tension in the wire, then the weight would lower to absorb this fluctuation in the wire tension.

In accordance with this principal embodiment of the instant invention, the machine is configured such that the weight resides in a mid portion of a six foot travel, so as to provide the capability of three upward feet of travel as well as three feet of downward travel for the weight. This is an ample amount of travel in order for the weight to be able to absorb the deviations in wire tension caused by the bumps in the road. This highly advantageous arrangement is in stark contrast with the old technology mentioned hereinabove, wherein a bump in the road causes the tension in the wire to go up or to drop down abruptly, causing the tension in the wire on the wall to vary 5% to 10%.

Another factor to consider is that bumps in the road may be so sizable that the tension in the wire is increased to such an extent as to reach the breaking point of the wire. As previously mentioned, when the wire breaks, the wire that has lost its tension is not reusable, and such wire must be removed from the wall and discarded. This necessitates the wire winding operation to back up to the last point where proper tension exists in the wire remaining on the wall of the tank, where a clamp of a particular type was applied to cause the two ends of the wires to be clasped tightly together, thus to permit the wire wrapping to continue from that point.

It is quite significant to note that in accordance with this invention, if a bump is encountered in the road, this will not cause the wire to break, for the weight will advantageously raise to absorb this sudden increase in tension.

Another common problem encountered in wire wrapping is that the wire reel will on occasion hang up. That is to say it becomes momentarily hard to turn during the unreeling of the wire. This increases tension in the wire, and while using the techniques of the prior art, this can cause the wire to break. With the utilization of the instant invention, however, the weight will move upward to accept this momentary increase in tension in the wire. Sometimes the wire is really hung up and will not uncoil off the spool. While utilizing the techniques of the prior art, the wire will break inasmuch as the tension immediately runs up to the breaking point of the wire.

In accordance with the instant invention, however, the operator monitoring the vertical position of the weight is afforded a tangible period of reaction time which, although short, is usually sufficient for permitting the operator to stop the winding process prior to the wire actually breaking. It is thus to be seen that this new technology enables minor difficulties to be obviated during the uncoiling of the wire reel, and in many cases will provide the operator a sufficient amount of reaction tine for him to avoid the breaking of the wire.

Taking as an example an 8 gauge wire being tensioned over a length of 600 feet from zero tension to the optimum of 3,000 pounds of tension, is a known fact that this length of wire will stretch to an extent approximating three feet. In accordance with the just-described prior art procedure, it was necessary for the machine to be adjusted manually by the operator riding on the platform with his hand on the control of the pressure-applying pump, while looking at the position of the weight and adjusting the pump to maintain a constant position of the weight.

In accordance with another important embodiment of the instant invention, the problem of maintaining a consistent and proper tension in the wire may be handled automatically by virtue of limit switches provided at the upper end as well as the lower end of the path of travel of the weight. These switches are of course integrated into the electrical circuitry associated with this machine, and by way of example, these switches may be located 5 feet apart. The purpose of providing these limit switches is to automatically control the position of the suspended weight between the established limits of travel of the weight. As will be explained in detail hereinafter, this arrangement enables a highly effective automatic control of the tension in the wire.

As to the operation of this embodiment of my invention, when the weight is in the low position, indicating a lowered tension in the wire, it makes contact with the lower limit switch. This causes an electrical solenoid valve connected to the hydraulic or pneumatic pump to open and allow pressurized fluid to flow to the slipbrake, with the functioning of the slipbrake causing in this instance an increase in the tension of the wire. As the tension in the wire increases, the weight raises a relatively small distance, causing it to lose contact with the lower limit switch. This then causes a stoppage of flow of pressurized fluid to the slipbrake, which enables the vertical travel of the weight to stop and thus cause a constant tension to be maintained in the wire.

Conversely, if the weight makes contact with the upper limit switch, as a consequence of the tension in the wire increasing, the novel arrangement I utilize causes a different solenoid valve to open, with this particular valve permitting a flow of pressurized fluid out of the slipbrake, bringing about a reduction in tension in the wire and causing the weight to move down. As the weight drops slightly, contact is lost with the upper limit switch and the solenoid valve relieving the pressurized fluid from the slipbrake is reclosed, which reduces the downward travel of the weight, thus keeping the weight in suspension.

It has been found that in most instances the advantages associated with the automatically functioning of the instant machine outweigh the additional cost of implementing the above-described circuitry. The tension in the wire can, quite advantageously, be automatically controlled without the presence of an operator's full attention, with this of course serving to reduce labor costs.

I have ascertained that in the practice of the instant invention, the precise tension in the wire can be realized within less than 1% of the desired tension, which of course is a great improvement over the technology of the prior art. As previously mentioned, these earlier techniques permitted the tension in each individual wire to vary in excess of 10%.

It had earlier been mentioned that in accordance with another embodiment of this invention, the weight utilized for providing a conspicuous indication of wire tension may be mounted in a selectively movable manner upon a balance beam. As with the embodiments using a pulley-suspended weight, the weight utilized on a balance beam is mounted for motion in a direction such that its position is influenced by gravity. The motion of the movably mounted weight thus serves in each embodiment as a reflection of the amount of tension in the wire and provides, during operation of the machine, a conspicuous indication, on a substantially continuous basis, of any changes in tension in the wire.

As will hereinafter be described in considerable detail, the balance beam embodiment involves a low cost, low profile machine that makes possible the quick, precise adjustment of desired wire tension without the necessity of changing the size of the weight mounted on the balance beam.

It is therefore a primary object of this invention to provide a wire wrapping machine of minimal cost that will enable the tension in a wire being wrapped around a tank or other large structure to be maintained at a very precise value.

It is another object of this invention to provide a wire wrapping machine that will enable uniform tension to be realized in each wrap of wire around a tank or other large structure while at the same time minimizing labor costs.

It is still another object of this invention to provide a wire wrapping machine having means enabling in a non-complex manner the tension in each wrap of a wire around a large structure to be readily and accurately adjusted to meet precise design requirements.

It is yet another object of this invention to provide a wire wrapping machine that despite its relatively low cost will nevertheless enable a precisely accurate tension to be maintained in the wire being wrapped around the large structure, thus obviating the need for stopping the wrapping procedure from time to time in order to check the precise tension in the wire already applied to the structure, and to compare that tension with a gauge reading.

It is yet still another object of this invention to provide an economically produced wire wrapping machine that is able to wrap wire on a large structure so accurately to a preestablished value of tension that it becomes unnecessary to apply an additional wrap upon the structure, to make up for the fact that the already-applied wire might have been wrapped on the structure at an inadequate tension.

It is a further object of this invention to provide a wire wrapping machine that can demonstrably wrap a large structure to a high degree of accuracy, thus to prove to designers and inspectors alike that wire is being wrapped on a large structure to an entirely adequate degree of tension.

It is a yet further object of this invention to provide a wire wrapping machine having the ability to absorb sudden increases in wire tension, thus to give the operator increased reaction time in which to stop the machine should a problem threatening wire breakage unexpectedly occur.

It is a still further object of this invention to provide a wire wrapping machine utilizing a large weight maintained in suspension and capable of limited vertical movement, with the amount of tension in the wire being wrapped about the tank affecting the vertical positioning of the weight and being consistent with the mass of the weight, with changes taking place in the height of the weight used in accordance with the principal embodiment from a mid position during the wrapping procedure representing a conspicuous indication to the operator of changes occurring in the tension of the wire being wrapped.

It is another object of this invention to provide a wire wrapping machine that is automatic in operation and advantageously not requiring a full time operator.

It is still another object of this invention to provide a balance beam alternative to the weight suspended by means of a pulley arrangement, with the balance beam embodiment making possible the easy, quick and precise adjustment of desired wire tension without necessitating a change in the size of the weight being utilized.

It is yet still another object of my invention to provide a balance beam embodiment wherein the position of the weight slidably mounted on the balance beam can be easily and precisely adjusted by the operator, thus to readily enable a selected wire tension to be achieved, with this embodiment also providing the advantage of a low profile machine.

These and other objects, features and advantages will be more apparent as the description proceeds.

BRIEF DESCRIPTION OF DRAWINGS

FIG. 3 is a view to a still larger scale of a hydraulically powered wire tensioning assembly that may be used for maintaining proper tension of the wire being wrapped around the tank by the operation of my wire wrapping machine;

FIG. 3*a* is a plan view of the hydraulically powered tensioning assembly of FIG. 3, with this view revealing certain significant details of the control arrangement;

FIG. 5 represents a pneumatically powered embodiment of a wire tensioning assembly, which bears some resemblance to the previously-described hydraulically powered wire tensioning arrangement of FIG. 3;

FIG. 8 is a die stressing arrangement utilized as a wire tensioning assembly, which arrangement is usable with either a hydraulically powered or a pneumatically powered brake system;

FIGS. 9*a* and 9*b* illustrate pulley arrangements usable in accordance with this invention as alternatives to the pulley arrangement described in conjunction with FIG. 2.

DETAILED DESCRIPTION

Figure 1:
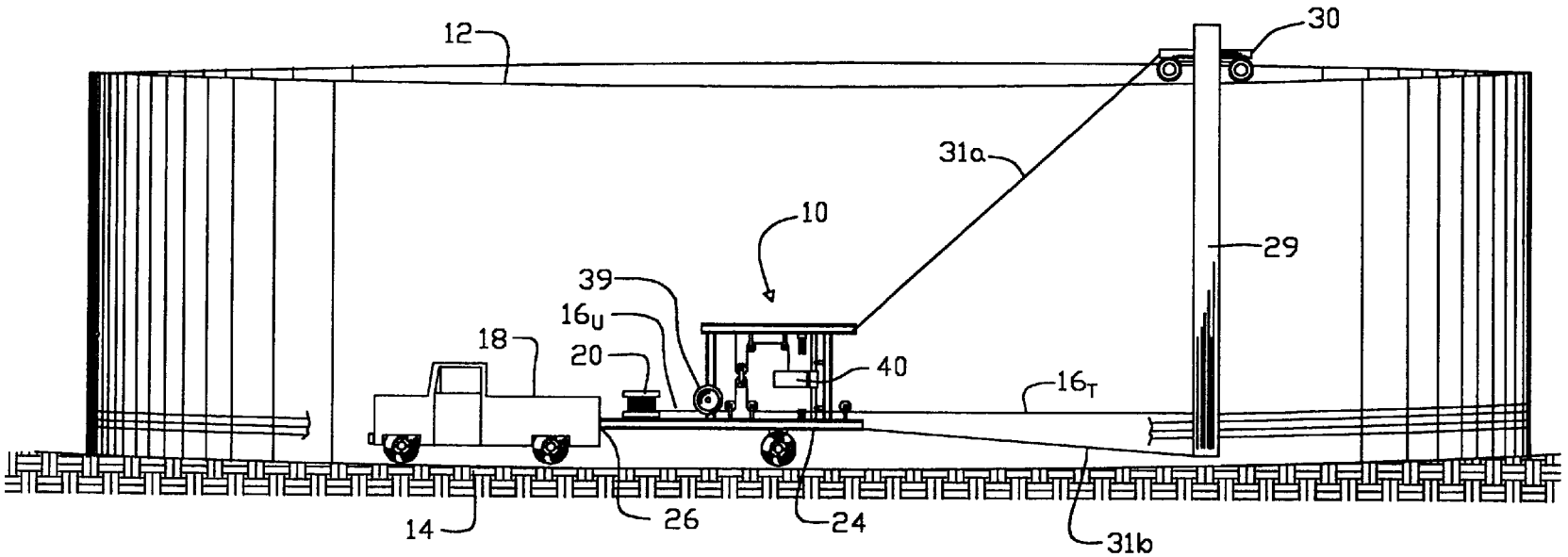
FIG. 1 is a somewhat simplified overall view of a principal embodiment of my novel wire wrapping machine, shown in this instance in front of a large tank to be tightly wrapped with wire, with my novel machine here being towed by a prime mover.

With initial reference to FIG. 1, it will be noted that I have illustrated a primary embodiment of my novel wire wrapping machine 10, disposed in front of a structure to be wrapped with wire. The structure in this instance is a large tank 12 residing on ground surface 14. The tank 12 is typically of prestressed concrete, with the wrapping of the tank tightly with wire serving to substantially increase the bursting strength of the tank.

The prestressed tank 12 is typically of circular cross section with a diameter between 30 feet and 300 feet. The height of the tank in most instances will be in the range of 10 feet to 50 feet, and the tank may or may not have a roof. Although a circular tank is typical, my invention can also be applied to non-circular structures such as tanks that are either of elliptical or elongate configuration. Tanks of several different configurations are illustrated and described in my Pat. No. 5,590,497, which issued Jan. 7, 1997.

In accordance with customary procedure, the tank 12 is tightly wrapped in a helical manner, with the wire wrapping preferably commencing at the bottom of the tank and proceeding upwardly. A device 29 known in the industry as a wire spacer is utilized to assure an even wrapping of the wire on the tank or other structure. I utilize the designation $\mathbf{16}_T$ to indicate wire that has been tensioned by the use of my novel wire wrapping machine 10, whereas the untensioned wire mentioned hereinafter is designated $\mathbf{16}_U$. The wrapping details will shortly be explained in greater detail.

In the instance illustrated in FIG. 1, a prime mover 18 driven on the ground surface 14 is utilized for causing my novel wire wrapping machine 10 to pass around the outer periphery of the tank 12 for a large number of times during the tank wrapping procedure. As a matter of passing interest, the prime mover 18 could be a front end loader, a tractor, a crawler tractor, or similar machine. I have found that a prime mover with a rating of one hundred twenty horsepower is quite sufficient for providing the power needed for pulling the wire wrapping machine 10 at a good working speed.

As depicted in FIG. 1, my novel wire wrapping machine 10 may be operatively associated with a trailer being towed for a large number of turns about the tank, but it is to be understood that my novel wire wrapping device could be mounted directly upon and supported by the prime mover 18. From the efficiency standpoint, there are significant advantages in placing the wire wrapping machine 10 on the back of the prime mover 18, with these advantages including the fact that the wire wrapping operation will generally be faster. On the other hand, one of the drawbacks of such an arrangement is the cost involved in the specialized equipment that becomes necessary.

Figure 2:
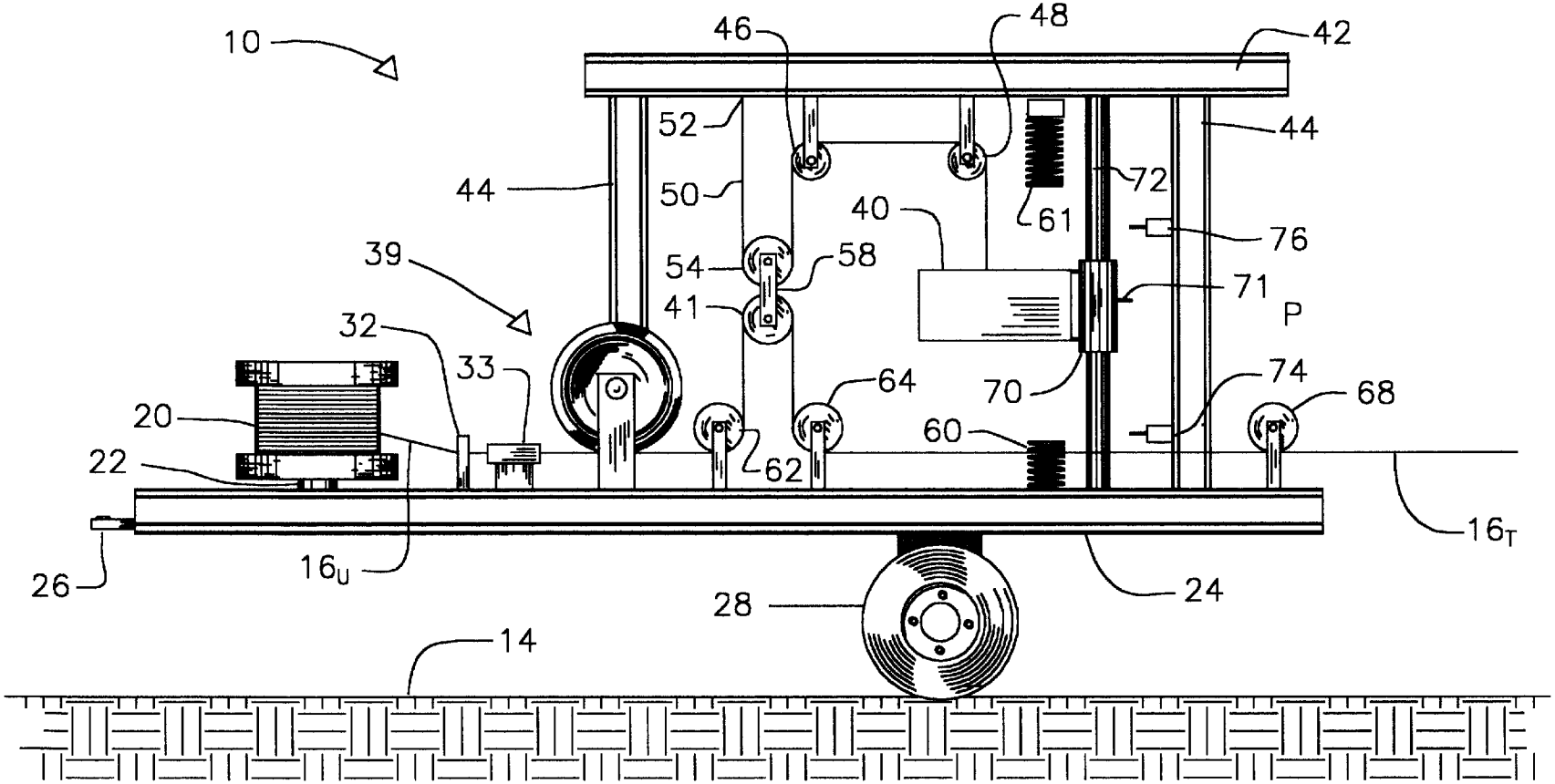
FIG. 2 is a view to an enlarged scale of certain important aspects of the principal embodiment of my novel wire wrapping machine, with this view revealing the components typically utilized for suspending a large weight, with cables and pulleys, for limited vertical movement, with the weight advantageously providing a display of the tension in the wire being wrapped around the tank, and with electrical circuitry able to be utilized in conjunction with the positioning of the weight such that it is readily possible to automatically maintain the weight at or near its desired operating position.

A wire supply spool or reel 20 is rotatably mounted adjacent one end of the novel wire wrapping machine 10, which in this instance is carried by a wheeled platform or trailer 24. The spool or reel 20 provides the wire that is thereafter tensioned and evenly applied around the exterior surface of the structure 12. As illustrated in FIG. 2, the spool or reel 20 rests on a turntable 22 and feeds wire $\mathbf{16}_U$ through a wire guide 32, a pretensioner 33 and thereafter onto a wire tensioning assembly 39. The pretensioner 33 and the wire tensioning assembly 39 will each be described in detail hereinafter.

With continuing reference to FIG. 1 it has already been mentioned that in order to properly position the tensioned wire $\mathbf{16}_T$ on the structure 12, the wire spacer 29 is used, which is designed to be supported by a wheeled support device 30 designed to ride along the top of the wall of the tank 12. The device 30 is pulled by an upper cable 31*a* and a lower cable 31*b*, which are visible in FIG. 1.

It is to be noted that wire spacers 29 of the type depicted in FIG. 1 are well known in the industry, with these devices serving to bring about even spacing of the wire around the walls of the tank rather than either bunching up or else being placed at too wide a spacing. In FIG. 1 I have depicted the previously applied wires, or wraps as they are often called, applied in a helical manner in an upward direction. In the Bush et al Pat. No. 4,801,103, which issued Jan. 31, 1989, a carriage concerned with a desirable predetermined spacing of the wire being wrapped on a tank is described, which carriage travels on rollers about the upper rim of the tank.

Turning now to FIG. 2, here I have shown a towed version of my novel wire wrapping machine 10 in greater detail so as to reveal its unique features. The wire wrapping machine 10 is mounted on the aforementioned wheeled platform 24, which typically would be constructed of welded steel, although other structural materials might well prove suitable in some instances. The platform 24 has a trailer hitch 26 for connection to the prime mover 18, with wheels 28 being provided for the support of the platform. Because the ground surface 14 may in some instances be relatively soft, I prefer to utilize wheels such as sixteen inch truck wheels having a wide tread.

As revealed in FIG. 2, the spool or reel 20 serving as the wire supply rests on the turntable 22, with the wire on the spool or reel 20 preferably being high strength steel that meets the requirements of standard ASTM A-648 or A-821. I prefer to tension wire having a diameter of 0.162 inches to 3,000 pounds of tension, whereas I prefer to tension wire having a diameter of 0.192 inches to 4,250 pounds of tension. The spool or reel 20 may contain approximately fifteen thousand lineal feet of wire. Wire made of other drawn materials which have a sufficient tensile strength can be used. It is important to note that when I refer to Tire in this instance I do not intend to exclude cable, which may be particularly ideal for use in certain instances. The cable would typically have a diameter ranging up to ⅜ inch.

The novel pulley arrangement I regard as the primary embodiment of my invention is depicted in FIG. 2 and it will shortly be described in detail.

With reference to the right hand side of FIG. 2, it will be noted that a payoff wheel 68 is utilized for guiding the tensioned wire $\mathbf{16}_T$ as it leaves the wire wrapping machine 10 on its path to the structure 12.

I prefer to impart a suitable amount of initial tension to the wire before it reaches the wire tensioning assembly 39, with this initial tension being created by the aforementioned pretensioner 33. The pretensioner 33 may involve the use of two closely fitted blocks of steel, between which the wire passes. One of these blocks is mounted to the platform, whereas in the preferred embodiment, a powered actuator, such as a hydraulic cylinder 34 is attached to the other block; note FIG. 3*a*.

With particular reference now to FIGS. 3 and 3*a*, an arrangement for achieving a desirable amount of wire tension is depicted, utilizing components powered by hydraulic pressure, although it is to be understood that pneumatically operated components could be used as well. In FIGS. 3 and 3*a* it will be seen that a hydraulic pump 35 is interconnected with hydraulic cylinder 34 by means of a line or pipe 36, with the pump being equipped with a handle 37 and a relief 38. This arrangement makes it possible for the operator to cause the pretensioner 33 to provide a desirable amount of pretensioning to the wire before it reaches the wire tensioning assembly 39, where this latter device serves to change the wire $\mathbf{16}_U$ from a non-tensioned state to a tightly tensioned wire, to which the designation $\mathbf{16}_T$ is applicable. As an alternative to the previously mentioned pretensioner utilizing two blocks of steel sandwiching the wire, a pretensioner configuration in the form of a slipbrake may be installed on the turntable 22, with this arrangement of course being fully adjustable.

The embodiment of my invention involving the use of a slipbrake on the turntable utilized for supporting the wire roll 20 will be discussed hereinafter in conjunction with FIG. 10.

Now with particular reference to the details of the hydraulically powered wire tensioning assembly 39, this assembly is best seen in FIGS. 3 and 3*a*. I prefer to regard as a capstan 80, a cylindrically-shaped device whose outer circumferential surface is directly contacted by the wire. The wire is typically fed around the rotatable capstan 80 several times. I have found that wrapping the wire around the capstan 80 seven times, coupled with the relatively small amount of back tension created by the pretensioner 33, causes the development of sufficient friction between the wire and the capstan 80 as will prevent the wire from slipping circumferentially on the capstan while the wire is being tensioned.

I prefer to use a capstan equipped with side flances, with a sloping face extending between the flanges; note FIG. 3*a*. The wire being fed onto the capstan feeds on what may be regarded as the larger diameter or high side, whereas the wire leaving the capstan leaves from the smaller diameter or low side of the capstan. Because of this arrangement, the wire tends to slide down the sloping face of the capstan, which in most instances prevents tangling. However, in some instances it may be desirable to utilize a bullwheel arrangement involving a pair of drums. At least one of these drums has grooves in which the wire or cable rides and is equipped with a brake, whereas the other drum is an idler type wheel that usually has no brake. By transferring the wire from one drum to the other, the wire can be moved to another groove. Bullwheels are known in the industry, and the details of such an arrangement need not be illustrated herein.

It will be noted from FIG. 3 that the capstan 80 is mounted on a support shaft 82 that is in turn supported by an upright member 84. As is obvious, it is desirable to have the counterpart of the member 84 located on the other side of the capstan 80 in order that it will be properly supported upon the wheeled platform 24; note FIG. 3*a* in this context.

What I prefer to regard as a slipbrake 88 is comprised of the capstan 80, brake drum 90 and brakes shoes 92, with the brake shoes 92 being depicted in FIG. 3. The brake drums 90 are attached to the capstan 80 and form an intrinsic part thereof.

In the illustrated embodiment, a hydraulic cylinder 94, visible in FIG. 3, is connected by means of cam arm 96 so as to cause the brake shoes 92 to move forcefully into contact with the inner circumferential surface of the drum 90 when pressure is applied to the hydraulic cylinder 94. However, as will be seen hereinafter, an arrangement employing pneumatic pressure could be utilized if such be preferred.

The hydraulic cylinder 94 (actuator) is selectively provided with fluid under pressure by the use of a hydraulic pump 100, visible in FIGS. 3 and 3*a*, which is under the control of the * operator. A pump handle 102 is provided for manipulation by the operator, and a pressure relief 104 is provided for the prevention of an undesirable amount of overpressure. To be noted is the fact that the pressure relief may be readily manipulated by the operator.

As revealed in FIG. 3*a*, a hydraulic line or pipe 95 may interconnect the pump 100 with a pair of the hydraulic cylinders 94, so that a braking effort can be conducted from both sides of the capstan 80.

By this arrangement it is thus to be seen that the operator can, by suitable operation of the controls associated with the pump 100, bring about either an increase or a decrease in the hydraulic pressure manifested in the pair of hydraulic cylinders 94.

As the wire wrapping takes place, the capstan 80 and the operatively associated brake drum 90 (an intrinsic part of the capstan) spin around shaft 82 as the wire $\mathbf{16}_T$ is being paid out. As should now be clear with regard to the operation of ray device, the amount of tension placed in the wire $\mathbf{16}_T$ is adjustable by increasing the hydraulic pressure on the slipbrake 88, and thus alter in selected manner, the amount of force exerted by the brake shoes 92 against the inner circumferential surface of the rotatable brake drum 90.

By the appropriate manipulation of the controls associated with the hydraulic pump 100 to bring about an increase in the hydraulic pressure applied to the components operatively associated with the slipbrake 88, an increase in the braking force applied to the wire $\mathbf{16}_T$ wrapped around the capstan 80 may readily be brought about. This obviously requires a greater tension in the wire in order to cause the capstan 80 to spin around the support shaft 82. When on the other hand the operator moves the pressure relief 104 associated with the pump 100 so as to reduce hydraulic pressure, and thus reduce the force applied to the slipbrake 88 by the brake shoes 92, the tension in the wire $\mathbf{16}_T$ is caused to reduce.

Whereas the use of drum brakes is preferred, other brake systems are possible, such as the use of an adapted form of disk brakes.

Figure 10:
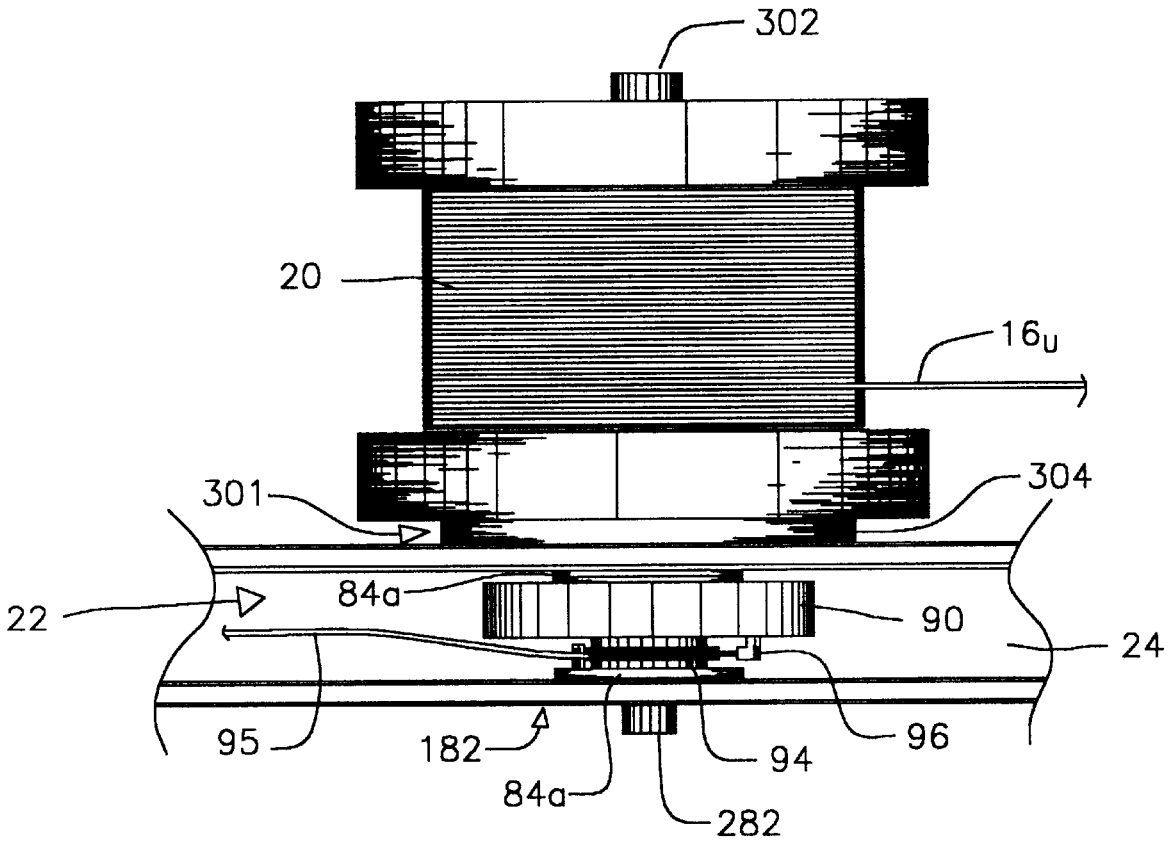
FIG. 10 is a view to a large scale of an embodiment of my invention wherein a braking effort may be applied by a slipbrake to the pretensioning device I may use.

It may be recalled that I may elect to utilize a slip brake in conjunction with the turntable 22 forming the support for the wire roll 20, with this feature being discussed, as previously mentioned, in conjunction with FIG. 10.

In accordance with a preferred embodiment of my invention, the path of the tensioned wire $\mathbf{16}_T$ between the wire tensioning assembly 39 and the payoff wheel 68 is deflected by a pulley arrangement, which includes the use of a wire deflection wheel 41 whose position is directly affected by a heavy weight 40, clearly visible in both FIGS. 1 and 2. I may refer to the suspended weight 40 as the tension indicating means inasmuch as it serves to indicate in a clear and unmistakable manner, the tension in the wire $\mathbf{16}_T$ being wrapped. As will shortly be discussed in greater detail, the wire deflection wheel 41 is connected so as to react to the weight 40, with this weight serving in a manner described hereinafter to enable the tension in the wire $\mathbf{16}_T$ to be maintained at a consistent and preascertained value.

In order to discuss the pulley arrangement I prefer, attention is directed to FIG. 2 where it is to be seen that the wheeled platform 24 is provided with a superstructure 42. The superstructure 42 is held in an essentially parallel relationship to the platform by a series of sturdy uprights or supporting columns 44, which typically are in a parallel relationship to each other and in a perpendicular relationship to the platform 24.

Suspended from the underside of the superstructure are a pair of rotatably mounted pulleys 46 and 48 over which a strong, flexible cable 50 passes. One end of the cable 50 is attached at 52 to the underside of the superstructure 42, with the cable then forming the support for the rotatably mounted pulley 54 and thereafter passing over the pulleys 46 and 48, as will be noted from FIG. 2. The cable 50 then forms the direct support for the large weight 40 that serves as the tension indicating means. In place of the cable 50 utilized in the embodiment depicted in FIG. 2, it is to be understood that a chain or other suitable flexible tensile material could be used in the support of the weight 40.

It will be noted from FIG. 2 that a relatively large strap 58, such as of steel, extends between the axle of the pulley 54 and the axle of the earlier mentioned wire deflection wheel 41, so as to hold these two rotatable members in a fixed, spaced relationship. Actually, a second strap 58 (not shown) is utilized on the backside of the pulley 54 and the wire deflection wheel 41 to assure these members remaining in a common plane.

It will be apparent to those skilled in the art that as a result of the effect of gravity, the weight 40 exerts a force tending to cause the rotatably mounted pulley 54 to rise, and because of the straps 58, to cause the wire deflection wheel 41 to also rise. This upward force is of course countered by the tension in wire $\mathbf{16}_T$, which tension, as previously mentioned, tends to pull downwardly on the wire deflection wheel 41.

When during the wire wrapping procedure the wire $\mathbf{16}_U$ extending from the spool or reel 20 is slack, with little or no tension therein, the amount of upward deflection of the wire passing over the wire deflection wheel 41 is at a maximum and the weight 40 rests in its lowered position. I prefer to provide a compression spring 60 upon which the weight 40 rests during times of slack tension.

When the wrapping of the tank is underway, tension is imparted to the wire by the wire tensioning assembly 39, a substantial downward force is exerted by the wire $\mathbf{16}_T$ on the rotatably mounted wire deflection wheel 41. This force is trying to reduce the deflection in the wire $\mathbf{16}_T$ caused by the force of the weight 40 manifested upon the wire deflection wheel 41. As the tension in the wire $\mathbf{16}_T$ increases, due to the functioning of the wire tensioning assembly 39, the downward force on the wire deflection wheel 41 is necessarily increased. Inasmuch as the rotatable deflecting wheel 41 is connected by the straps 58 to the pulley 54 directly concerned with the support of the weight 40, this increased force causes the weight 40 to be raised away from contact with the compression spring 60.

With continued reference to FIG. 2, wherein I show a preferred pulley arrangement, it will be noted that the tensioned wire $\mathbf{16}_T$ leaving the wire tensioning assembly 39 is fed under a pulley 62 and over the previously described wire deflection wheel 41, thereafter passing under a pulley 64. The pulleys 62 and 64 are both mounted in a rotatable relationship upon the platform 24, with these two pulleys being spaced apart in a carefully aligned, parallel relationship so that the wire leaving the wire tensioning assembly 39 will remain in essentially a single plane as it travels under pulley 62, over the wire deflection wheel 41, under the pulley 64, thereafter exiting past the payoff wheel 68 and moving into contact with the tank 12. This is the preferred arrangement inasmuch as it is desired to simplify the relationship of the tension in the wire $\mathbf{16}_T$ to the weight 40 and make necessary adjustments readily possible. It is to be understood that the configuration of the cable 50 and pulleys as shown in FIG. 2 provides a highly desirable one to one relationship between the weight 40 and the tension in the wire $\mathbf{16}_T$.

In accordance with the functioning of my novel device, the tension in the wire $\mathbf{16}_T$ is caused to be increased to a desirable extent during the wire wrapping procedure by operation of the wire tensioning assembly 39 until the weight 40 is caused, by movement of the prime mover, to rise from its resting position to an operating position P. A significant relationship necessarily exists between the tension in the wire $\mathbf{16}_T$ and the weight 40, which is a function of the mass of the weight 40. I find it desirable in accordance with the preferred embodiment of pulleys depicted in FIG. 2 for the relationship to be such that the predetermined tension in the wire $\mathbf{16}_T$ is equal to the weight 40. This relatively simple arrangement is only one of several workable configurations, and other pulley arrangements usable in accordance with this invention will be discussed hereinafter.

With continuing reference to FIG. 2, while the weight 40 is kept suspended at or near its normal operating position P, the tension in the wire $\mathbf{16}_T$ will be constant during the wrapping procedure. By using this significant relationship, the tension in the wire $\mathbf{16}_T$ being used to wrap the tank 12 can quite advantageously be predetermined by establishing an apt and appropriate size for the weight 40.

It is to be noted that if the tension in the wire $\mathbf{16}_T$ is increased above the tension required to suspend the weight 40, it will be immediately apparent to the operator that the weight is tending to rise toward its upper limit. On the other hand, if the tension in the wire $\mathbf{16}_T$ is decreased below the tension required to suspend the weight 40, the weight will noticeably tend to lower toward its resting position on the compression spring 60. It is important to realize that once the weight is suspended, a small variation in the tension in the wire $\mathbf{16}_T$, less than one percent, will cause the weight 40 to move up or down relative to its normal operating position P, and quite advantageously, this motion of the weight will be quite conspicuous to the operator. By virtue of this highly desirable arrangement, the tension in the wire $\mathbf{16}_T$ can readily be maintained at a consistent, predetermined level as a result of keeping the weight 40 in a suspended mode.

It should now be clear that upon a weight 40 of predetermined mass being established, the tension in the wire $\mathbf{16}_T$ will remain consistent therewith during the wrapping procedure as long as the weight 40 utilized in this embodiment of my invention continues in a suspended condition.

As to the operation of my invention, the prime mover 18 propels the wheeled platform 24 around a structure 12 in a continuous motion, with the platform carrying the wire supply 20. The initially untensioned wire $\mathbf{16}_U$ is brought into a tensioned condition, principally by operation of the wire tensioning assembly 39, with the tensioned wire $\mathbf{16}_T$ thereafter passing under the pulley 62, over the wire deflection wheel 41, and under the pulley 64 before passing over the payoff wheel 68 and onto the structure 12.

The tension in the wire $\mathbf{16}_T$ is adjusted until a weight 40 of suitable mass is raised above its resting position to the operating position P visible in FIG. 2. The tension in the wire $\mathbf{16}_T$ required to keep the weight 40 in the suspended position will of course be the predetermined tension.

If during the operation of my novel device the tension in the wire $\mathbf{16}_T$ drops below a desired value during the wire wrapping procedure, it should now be obvious that the weight 40 will lower and eventually come to rest on the compression spring 60. Although such a spring is not mandatory, I prefer to utilize the lower spring 60 as well as an upper compression spring 61 in order to dampen both the lower and upper termination points.

Undesirable lateral movement of the weight 40 is prevented by the utilization of a guide 70 which slides along a fixed guide rail 72. As revealed in FIG. 2, the guide rail 72 is preferably secured in a vertical attitude with respect to the platform 24 and the superstructure 42, but in some instances the guide rail could be disposed at an angle so that the weight 40 will not move in a vertical plane during operation of my device.

Figure 4:
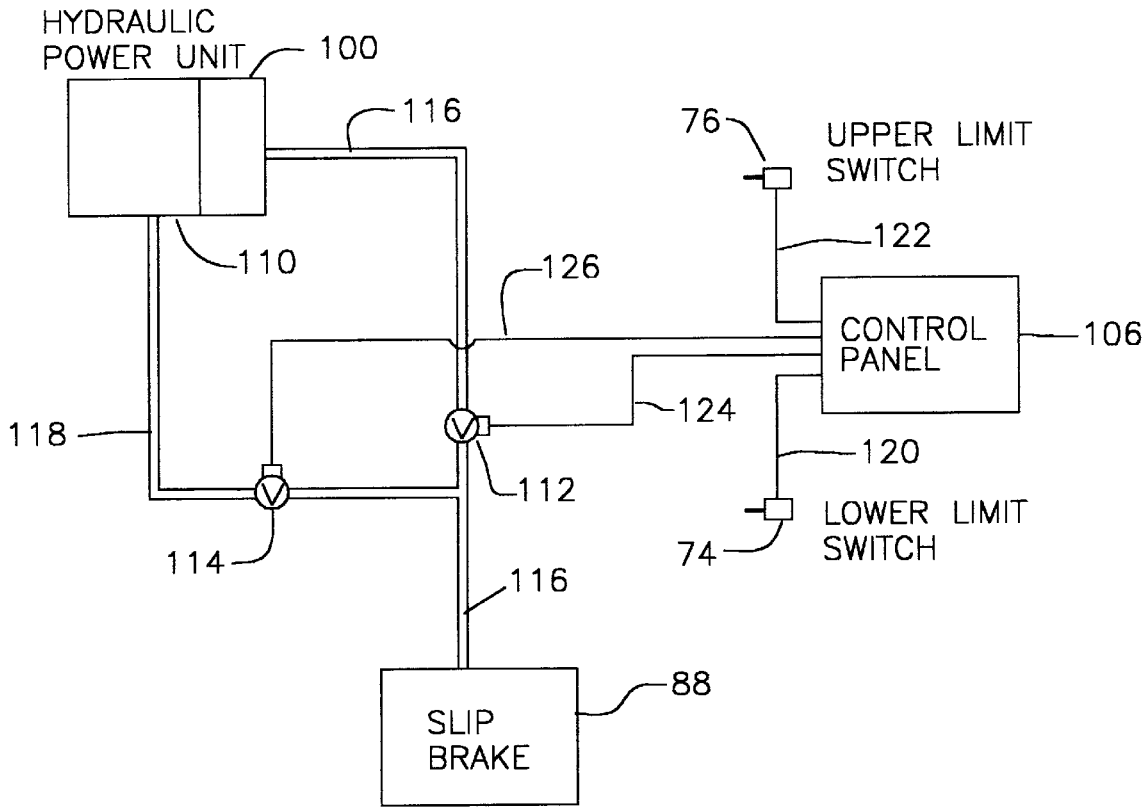
FIG. 4 is a block diagram revealing components including limit switches that are utilized for achieving automatic tensioning of the wire being wrapped around the tank, with this embodiment being hydraulically powered.
Figure 4A:
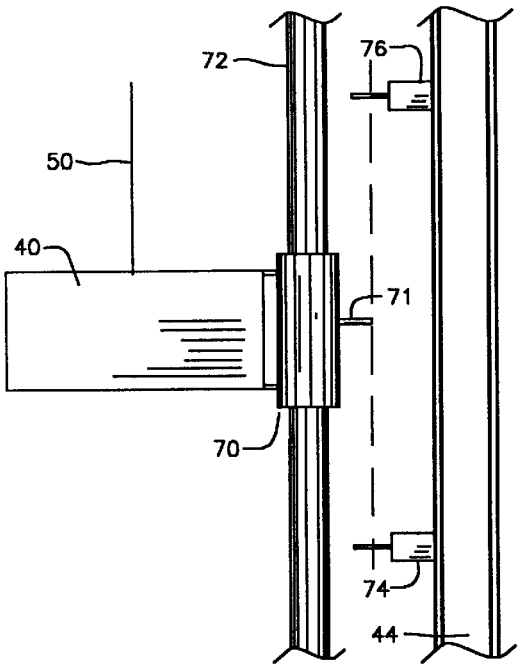
FIG. 4*a* is a fragmentary view, to a substantially large scale, revealing the optional use of a triggering device in conjunction with the upper and lower limit switches depicted in FIG. 4.

One of the modifications that may be made in this hydraulically powered embodiment of my invention may involve an automatically functioning arrangement for maintaining a constant tension in the wire $\mathbf{16}_T$, and to this end I install closely adjacent the guide rail 72, a lower limit switch 74 and an upper limit switch 76; note FIG. 2 as well as FIG. 4*a*. For example, the limit switches may be mounted upon an adjacent column 44 in an appropriately spaced relationship. Upon the weight 40 moving downwardly into contact with the lower limit switch 74 as a consequence of a decrease in tension of the wire $\mathbf{16}_T$, an electrical circuit operatively associated with components shortly to be described is caused to close, with this bringing about the restoration of proper tension in the wire $\mathbf{16}_T$. If, however, the weight makes contact with the upper limit switch 76 as a consequence of an increase in the tension in the wire, the novel arrangement I utilize automatically brings about a reduction in tension in the wire, causing the weight 40 to move back to its operative position. As visible in FIG. 4*a*, a triggering device 71 may be utilized on the guide 70 in order to assure a consistency in the actuation of the upper or lower limit switch. The triggering device may in turn be attached to the weight 40. More details of the preferred means for modifying the tension in the wire will shortly be provided.

Each of the limit switches I prefer to use is a heavy duty snap action device with a protruding wobble stick. These are common in the industry and are inexpensive, very reliable, easy to mount, and are weatherproof. The triggering device 71 that I prefer involves a flat steel plate ¼" thick, 8" long and 6" wide mounted on the guide 70.

As the weight 40 moves vertically, the triggering device 71 contacts the wobble stick portion of one of the limit switches. I have found that this combination works well while allowing the triggering device 71 a degree of variation in lateral position.

It is to be understood that travel of the weight 40 is limited by the positioning of the lower compression spring 60, which represents the rest position for the weight, and the upper spring 61. Although such is not a requirement, I prefer for the permitted length of travel of the weight 40 to be approximately six feet. In the preferred pulley configuration, this allows for the same amount of vertical excursion of the wire $\mathbf{16}_T$.

I have found it highly desirable to arrange for this rather substantial amount of permissible vertical travel of the weight 40 inasmuch as this allows for a desirable extent of movement of the weight due to the machine traveling over a non-uniform ground surface 14, during which time, the wire to be wrapped around the large object is of course being fed from the spool or reel 20.

With regard to the limit switches mentioned in connection with the hydraulically powered embodiment depicted in FIG. 2, reference is now made to FIG. 4, wherein the lower limit switch 74 and the upper limit switch 76 are represented in the context of a block diagram. The control panel 106 that I prefer to use contains a suitable electrical power source and in this present configuration has provisions for two circuits. The first circuit is between the lower limit switch 74 and a solenoid valve 112, latter being operatively disposed in the hydraulic pressure line 116, whereas the second circuit is between the upper limit switch 76, and a solenoid valve 114 operatively disposed in the relief hydraulic line 118 leading back to a hydraulic tank or sump 110.

The lower limit switch 74 is connected to the control panel 106 by lead 120 whereas the upper limit switch is connected to the control panel by lead 122. The control panel 106 is preferably supplied with electrical power from a 24 volt source. An electrical lead 124 from the control panel is connected to normally closed solenoid valve 112, whereas electrical lead 126 is connected from the control panel to normally open solenoid valve 114. As will be noted from FIG. 4, the solenoid valve 112 is disposed in hydraulic line 116 that serves to supply hydraulic pressure to slipbrake 88, whereas solenoid valve 114 is disposed in hydraulic line 118 that permits hydraulic fluid to return to the tank or sump 110 of the hydraulic power unit.

Upon the weight 40 lowering into contact with the lower limit switch 74 during the wire wrapping procedure, a suitable voltage is caused to be supplied by the control panel 106 to the normally closed solenoid valve 112, causing it to open and to permit high pressure hydraulic fluid to cause the slipbrake 88 to apply more resistance to rotation of the capstan 80, thus bringing about an increase in tension in the wire $\mathbf{16}_T$. As the tension in the wire increases, the weight 40 rises, causing it to lose contact with the lower limit switch 74. This causes a stoppage of flow of hydraulic fluid to the slipbrake, which enables the vertical travel of the weight to stop and thus cause a constant tension to be maintained in the wire $\mathbf{16}_T$.

The control panel 106 depicted in FIG. 4 is provided with an on-off switch so that the power can be readily turned on or off. Advantageously the hydraulic pressure to the slipbrake 88 goes to zero when the power in the control panel is turned off, and it is for this reason that the solenoid valve 112 is normally closed, so that it will shut off the flow of fluid to the slipbrake at that time.

When the weight 40 is in the desired operating position P between limit switches 74 and 76, the control panel, limit switches, and solenoid valves are configured to have the circuit between the upper limit switch 76, control panel 106, and the solenoid valve 114 located in the relief hydraulic line 118 energized to keep the normally open solenoid valve 114 closed. The circuit between the lower limit switch 74, control panel 106, and the solenoid valve 112 on the pressurized hydraulic line 116 is not activated at this time, so the normally closed solenoid valve 112 will remain closed.

On the other hand, if the tension in the wire $\mathbf{16}_T$ is caused to increase above the predetermined level, the weight 40 rises and will make contact with the upper limit switch 76. This in turn causes an electrical circuit to be broken between the upper limit switch 76, the control panel 106, and the normally open solenoid valve 114. This break in the circuit causes the normally open solenoid valve 114 to remain open and relieve the hydraulic pressure on the slipbrake 88. This brings about a suitable venting of fluid through the relief hydraulic line 118 to the hydraulic tank or sump 110.

This action in turn reduces the tension in the wire $\mathbf{16}_T$, and as a consequence, the weight 40 lowers. As the weight 40 lowers, the upper limit switch 76 is caused to complete the electrical circuit with the control panel 106 and the solenoid valve 114, which causes the valve 114 to reclose. This action stops the flow of hydraulic fluid from the slipbrake 88 back to the tank 110 and in turn lowers the tension in the wire $\mathbf{16}_T$. In this manner the tension in the wire $\mathbf{16}_T$ is automatically controlled at the predetermined level.

Other embodiments within the spirit of this invention are possible, as will be seen hereinafter.

With reference now to FIG. 5, at this location I depict an embodiment of my novel wire wrapping machine that is pneumatically activated, with it to be noted from this figure that the basic set-up for this pneumatically powered embodiment differs only slightly from the previously-described hydraulically powered arrangement. Reference numerals identical to those appearing in FIG. 3 represent the use in the embodiment represented by FIG. 5 of components identical or nearly identical to the components utilized in the device depicted in FIG. 3, with this including the functioning of the brake shoes, drums and capstan.

It will be noted in FIG. 5 that the supply for the pneumatic controls comes from a pressurized supply tank 200 which, in the preferred arrangement, may be a tank of nitrogen, inasmuch as it is clean, contains no moisture and is commonly available. In lieu of the nitrogen cylinder, however, any suitable compressed gas could be used, such as compressed air, or as another alternative, an air compressor with or without a tank could be utilized as the supply of the gas under pressure. As will be obvious to those skilled in this art, the foregoing pneumatic arrangement is utilized in lieu of the hydraulic pump 100 of the embodiment of FIG. 3, and the air cylinder 206 utilized in conjunction with the operation of the brake shoes in the embodiment of FIG. 5 is utilized in lieu of the hydraulic cylinder (actuator) 94.

With continued reference to FIG. 5, the air cylinder 206 concerned with the selective brake application is activated at such time as an air supply valve 202 is activated. The valve 202 is similar in function to the valve 102 utilized in the hydraulic embodiment of my invention depicted in FIG. 3.

Pressure in the air cylinder 206 is selectively relieved by the use of an air relief valve 204 depicted in FIG. 5, which is quite similar to the hydraulic relief device 104 of FIG. 3. In reducing the force applied by the brake shoes, the air relief 204 advantageously vents to the air, whereas in the hydraulic embodiment, it is necessary that the hydraulic valve 104 vent back into the hydraulic tank or sump 110 operatively associated with the hydraulic pump 100.

With still further reference to FIG. 5, it will be noted that the pretensioning unit 33 appearing in FIG. 5 operates in a similar fashion to that of the like device depicted in FIG. 3 except that the pretensioning unit of the embodiment of FIG. 5 is activated by air under pressure. An air cylinder (not shown) is activated by the air supply valve 202*a* or an air relief valve 204*a*. Both of the air supply valves are connected to the tank 200 representing the supply of pressurized gas. A pneumatically operated slipbrake may of course be placed on the turntable 22 and used as an initial tension device or pretensioner.

Although the configuration illustrated in FIG. 5 primarily envisions that the air cylinder 206 be activated by an increase in pressure brought about through the use of valve 202, it is to be understood that a reverse acting air cylinder 206 could easily be used. Such would be similar to the arrangement used on a conventional truck braking system wherein the brake is spring biased, with the brake being normally engaged. To relieve the brake, so that rotation may be permitted, an air cylinder 206 is activated against the spring, and as the air cylinder 206 is activated, the force by the cam arm 96 on the brake shoes is reduced.

In accordance with this latter system, as the air pressure in the cylinder 206 supplied by the valve 202 is increased, the net effect of the slipbrake 88 on the wire $\mathbf{16}_T$ is to reduce the tension in the wire. Conversely, as the air pressure to the cylinder 206 is reduced by engaging the air relief valve 204, then the tension in the wire $\mathbf{16}_T$ is increased. I prefer, however, to use the direct acting cylinder 206 wherein an increase in pressure through the valve 202 brings about an increase in the tension in the wire $\mathbf{16}_T$.

It will be recalled that in conjunction with the hydraulically powered embodiment of my invention depicted in FIG. 4, an automatic version of my machine was illustrated and described. I have found that an automatic version of my invention may be easier to implement by the use of air operated valves and cylinders rather than by hydraulically operated valves and cylinders. This is true inasmuch as a pneumatically powered embodiment involves a lower initial cost, and a supply of air is easier to achieve than is a hydraulic supply. A hydraulic arrangement necessitates the use of a hydraulic pump as well as return lines and a reservoir. However, I have found that when my invention is to be utilized in a manual mode, a hydraulically powered embodiment may be preferred. It is also true that operational costs are generally less when a hydraulically powered embodiment is utilized, for air is expended and hydraulic fluid is not.

Figure 6:
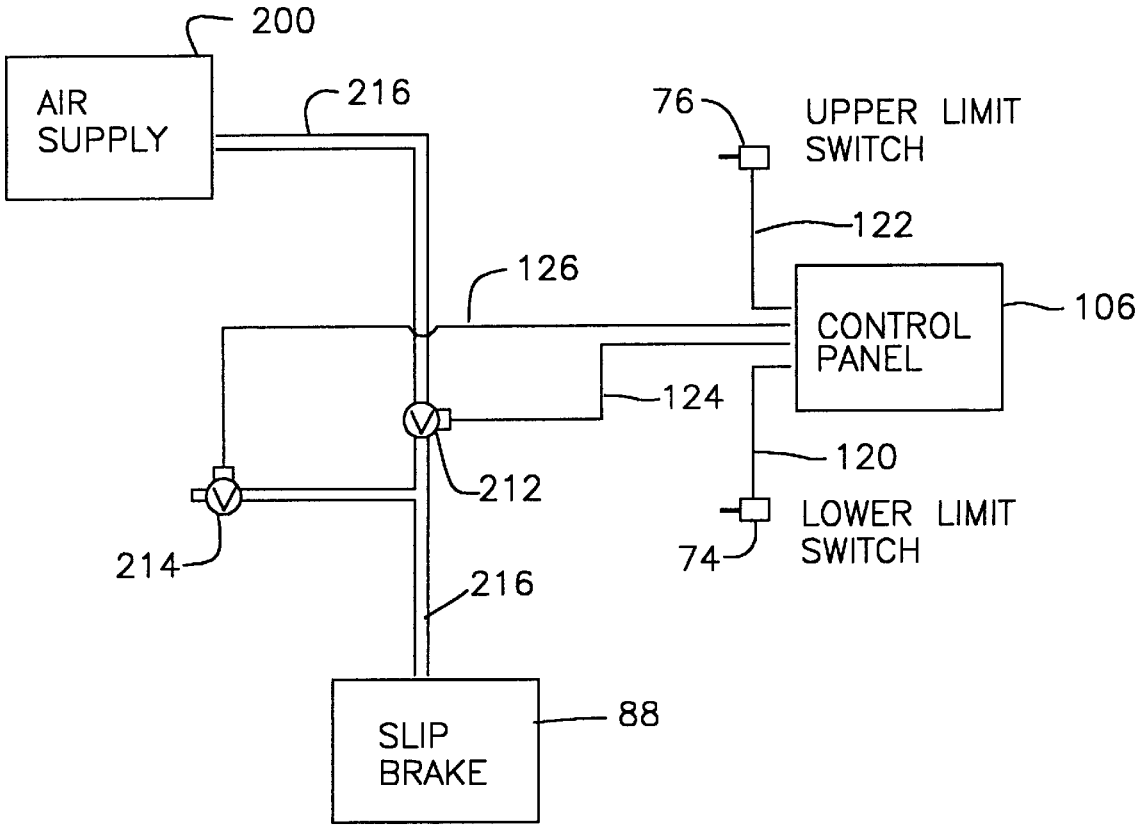
FIG. 6 is a block diagram revealing components including limit switches utilized in a pneumatically powered embodiment for bringing about automatic tensioning of the wire being wrapped around the tank, with this figure bearing a distinct resemblance to the hydraulically powered embodiment of FIG. 4.

In FIG. 6 I have depicted an automatically operable embodiment of my novel wire wrapping machine that is pneumatically powered, with it to be observed from this figure that the basic set-up for this pneumatically powered embodiment differs only slightly from the previously-described automatically functioning arrangement that is hydraulically powered. Reference numerals closely relatable to or identical with those appearing in FIG. 4 represent the use in the embodiment depicted in FIG. 6 of components comparable to the components utilized in the device depicted in FIG. 4.

It will be noted in FIG. 6 that the supply for the pneumatic controls comes from the pressurized supply tank 200, which may contain nitrogen, air or the like, or as another alternative, an air compressor with or without a tank could be utilized as the supply of the gas under pressure. It will be observed that the details of FIG. 6 rather closely resemble the details of FIG. 4, with one conspicuous difference involving the fact that valve 214 of FIG. 6 vents to the air whereas in FIG. 4, it is important that the hydraulic fluid be returned to the sump, this return being controlled by valve 114.

Figure 7A:
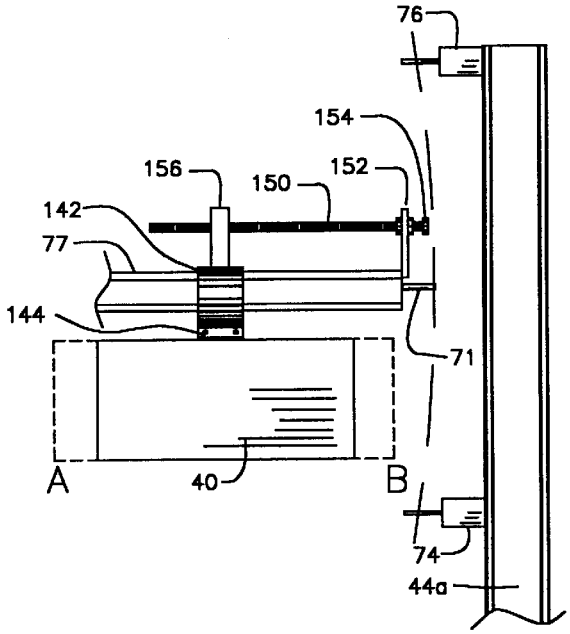
FIG. 7*a* is a view to a larger scale of the outboard end of the balance beam, revealing the upper and lower limit switches between which the outboard end of the balance beam may move in an arcuate manner, and also illustrating the use of a threaded rod that can be rotated to bring about a lateral change in position of the weight on the balance beam, thus to modify wire tension.
Figure 7:
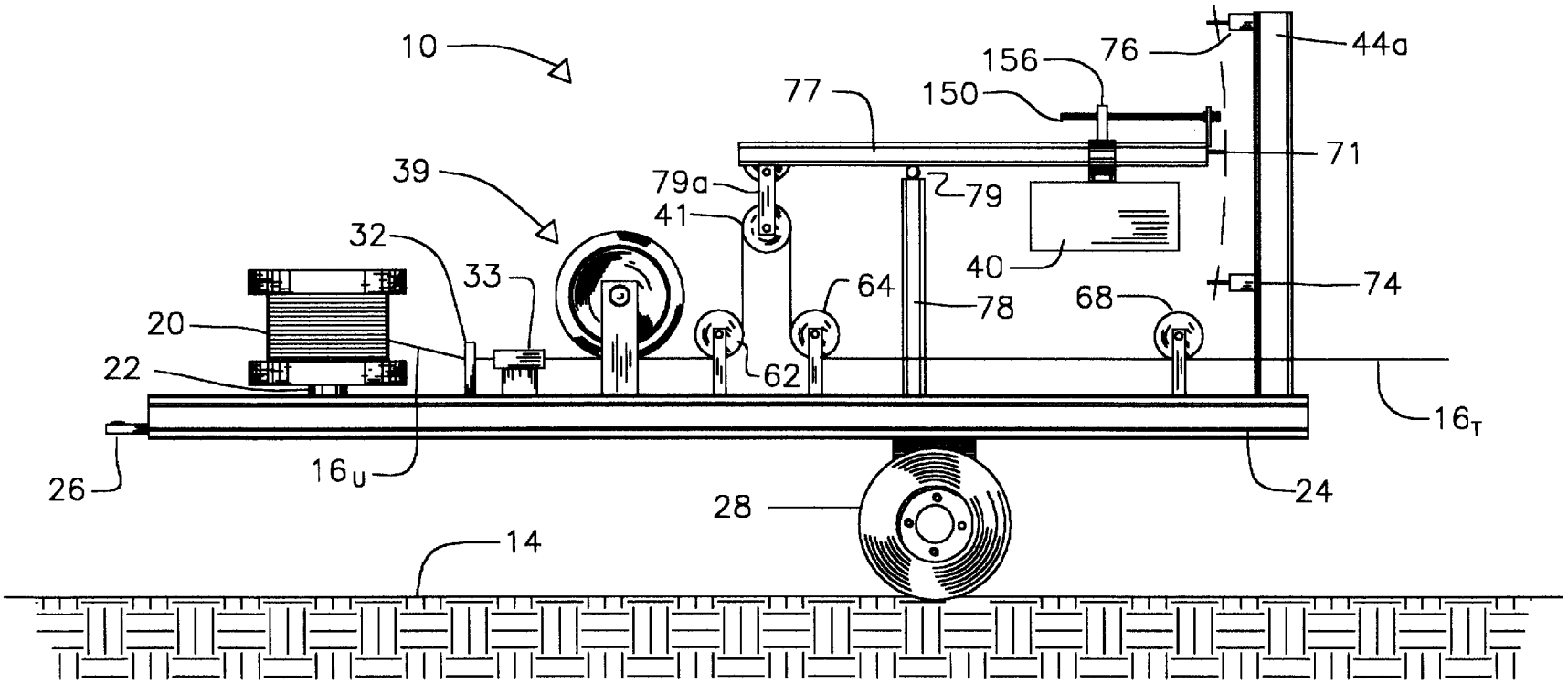
FIG. 7 is a view of another embodiment of my invention, wherein the movably mounted weight, rather than being suspended by a pulley arrangement, is instead slidably installed on a balance beam that is in turn mounted on a pivot point such that the outboard end of the balance beam is able to move in an arcuate manner and thus make any changes in wire tension conspicuous.

Turning now to FIG. 7, it is to be seen that I have here shown a variation upon my novel wire wrapping machine that uses a weight for conspicuously indicating any change in tension in the wire. For convenience I have adopted essentially the same reference numeral scheme utilized in connection with the earlier figures, except that in FIG. 7 I have depicted a balance beam 77 from which weight 40 is suspended. The balance beam utilized for the support of the weight is operatively mounted upon and supported by column 78, which is stably mounted in an upright position on the platform 24. The beam 77 may for example be a steel beam approximately 8' in length and have a 10" thickness, although I am obviously not to be limited to this.

It will be noted from FIG. 7 that a pivot 79 is mounted upon the upper end of the upright column 78, with the balance beam 77 normally resting in a generally horizontal position upon the pivot 79. By virtue of this arrangement, the balance beam 77 can be caused to move or tilt in a pivotal manner about the pivot 79 as the tension in the wire $\mathbf{16}_T$ is caused to change. I prefer to limit the rotation of the balance beam 77 to not more than 30° above or 30° below the depicted horizontal position, with a motion limiting stop (not shown) preferably being mounted on the platform 24 near each end of the balance beam.

I may employ a strap attached to the upper end of the column 78, with such a strap retaining the balance beam in the desired operating position while not inhibiting desirable and expected tilting movement of the balance beam about the pivot with changes in wire tension. This strap arrangement also permits proper alignment of the balance beam with the pulley arrangement I prefer to utilize.

It will be noted that the end of the balance beam 77 opposite from the suspended, slidably movable weight 40 has been provided with a pulley arrangement that involves wire deflection wheel 41, around which the tensioned wire $\mathbf{16}_T$ passes. A strap 79*a* is attached to the end of the balance beam remote from the weight 40, with this strap serving to support the wire deflection wheel 41. This arrangement permits the wheel 41 to remain in proper alignment with the pulleys 62 and 64 as the wheel 41 is caused to travel up and down with the beam as a result of changes in wire tension. As is obvious, as the tension in the wire $\mathbf{16}_T$ changes, the balance beam tilts away from the position illustrated in FIG. 7.

This balance beam arrangement will be seen to operate in a manner similar to scales used on weights and measures. When on one side the product of the weight and the distance to the pivot is equal on the other side to the product of the object being weighed and its distance to the pivot, the weight becomes suspended between its upper and lower limits. In this embodiment of my invention, I set the size of the weight 40, its distance to the pivot 79, and the distance from the pivot 79 to the point of connection with the wire deflection wheel 41 such that when the tension in the wire $\mathbf{16}_T$ reaches a predetermined tension, the weight 40 will be maintained in a suspended state in a manner generally similar to that described in conjunction with FIG. 2.

As will be readily understood, when the tension in the wire $\mathbf{16}_T$ rises above the predetermined tension, the wire deflection wheel 41 is pulled downwardly, causing the balance beam to tilt in such a manner that the weight 40 rises, whereas when the tension falls below the predetermined tension, the weight is caused to lower.

In the preferred version of the balance beam embodiment of my invention, I typically mount the wire deflection wheel 41 approximately 2½ feet from the pivot 79. The preferred weight is 3,000 pounds and will be mounted approximately 5 feet from the pivot 79 in order to produce a 3,000 pound tension in the wire $\mathbf{16}_T$ when the weight is residing in the normal operating position depicted in FIG. 7.

Continuing with the preferred version of the balance beam embodiment, the pivot 79 is typically located approximately 4 feet above the platform 24. With the balance beam 77 in a horizontal position, the overall height of this embodiment of my invention is just over 6 feet above the ground 14. This represents a lower profile than the preferred embodiment of my novel machine 10 depicted in FIG. 2, wherein cable and pulleys but no balance beam are utilized. As is obvious, the lower profile of the balance beam embodiment of my invention simplifies shipping from one location to another.

With particular reference now to FIG. 7*a*, it will be noted that I have depicted an enlarged fragmentary view illustrating the end of the balance beam 77 adjacent the weight 40. I preferably mount the weight 40 on the balance beam by the use of a collar 142 that permits the weight 40 to slide in a somewhat restricted manner along the balance beam 77. A significant advantage of the balance beam embodiment involves the fact that the desired tension in the wire $\mathbf{16}_T$ can easily be increased or decreased by merely relocating the position of the weight 40 on the balance beam. It is therefore to be seen that the tension in wire $\mathbf{16}_T$ can be readily modified without having to add to or subtract from the weight 40.

To enable positional adjustments of the weight 40 with respect to the beam, I prefer to utilize one or more screws 144 at a lower location on the collar 142, which can be tightened so that the weight will be maintained in a selected position on the balance beam 77. After the screws 144 have been loosened, the position of the weight 40 on the balance beam 77 can be readily changed in order to effect an increase or decrease in the tension in the wire $\mathbf{16}_T$. For example, if the weight 40 is moved to Position A shown by dashed lines in FIG. 7*a*, the desired tension in the wire $\mathbf{16}_T$ will be reduced, whereas if the weight is moved to Position B shown by dashed lines in this same figure, the tension in the wire $\mathbf{16}_T$ will be increased.

A simple way to move the weight 40 is to loosen the screws 144 and to slide the weight along the balance beam 77 by pushing or helping it along by striking the collar 142 with a hammer or similar implement. Preferably, however, I make possible a precise adjustment of the position of the weight 40 by the use of an arrangement involving an elongate, rotatably mounted screw 150 as depicted in FIG. 7*a*. The screw of my preference is a coarsely threaded steel rod 1" in diameter, which is known in the industry as a coil rod. Operatively associated with the screw 150 is a threaded post 156 that is mounted upon the collar 142, with the post 156 having female threads that match and properly interrelate with the external threads of the screw 150. The end of the rod remote from the post 156 is fastened to an end post 152 in a manner that restrains lateral or longitudinal movement of the screw while still permitting its rotation. The end post 152 is made of a ½" thick steel bar and is attached to the balance beam. I prefer to have a hexagonal nut 154 fixed to the end of the threaded rod 150 to facilitate rotation of the rod 150 by the operator. By utilizing coarse, relatively loosely fitting threads, this enables ready rotation of the screw, with the use of coarse threads also making them damage resistant.

As should now be obvious, by selective rotation of the threaded rod 150, the suspended, slidably movable weight 40 can be easily and precisely moved along the balance beam 77 to quickly enable a predetermined wire tension to be obtained. For the convenience of the operator, the balance beam 77 can be marked or calibrated to show the desired tension in wire $\mathbf{16}_T$ that will be achieved by positioning a given size weight 40 in a certain position.

Continuing with FIG. 7*a*, the upper limit switch 76 and the lower limit switch 74 are shown attached to a column 44*a* similar to column 44 in FIG. 4*a*. The triggering device 71 is conveniently attached to the end of the balance beam 77 and moves along an arc shown by a dashed line in both FIGS. 7 and 7*a*. This arc of course represents the path of travel of the device 71 as the balance beam may tilt about the pivot 79. For obvious reasons, the limit switches 74 and 76 are positioned at locations with respect to this arc so that reliably, the limit switches can be contacted during upward or downward movements of the triggering device 71. The aforementioned hexagonal nut 154 is located out of the vertical plane in which the limit switches 74 and 76 are located, thus preventing any undesirable contact between the nut 154 and either limit switch.

It is obvious that the desired tension can be calculated and preset by the known relationship of the position and size of the weight 40 on the balance beam 77. By using the previously mentioned mathematical relationship, the change in tension or desired tension can be calculated and preset by moving the weight 40 in an appropriate direction.

With reference now to FIG. 8, it will be noted in this instance that I have shown a die stressing arrangement utilized in lieu of a wire tensioning assembly in which the hydraulic brake system or pneumatic brake system is employed for achieving tension.

It is well known that pulling wire through a die is a process that typically is used in manufacturing to obtain the proper size of wire. In the present instance, the procedure could start with a 4,000 pound rod, which is in the shape of a coil. The rod may initially be of a ⅝" diameter, but in order to be usable for wrapping a tank, the rod has to be reduced in size to a substantial extent, so as to produce a wire that is of the proper diameter.

That this may be accomplished, the rod is pulled through a circular die, which in cross section is parabolically funnel shaped. Starting with a rod of about ⅝" diameter, it is successively pulled through approximately five dies, thereafter to emerge at a proper size. Quite a considerable force is required in order to pull the wire through a die to make it smaller, and through experimentation the actual force required to change a rod to a wire of a desired diameter can be determined.

In the present instance the tension in a prestressing wire can be achieved by starting, for example, with a wire of a diameter of 0.192 inches, and pulling it through a die having a working diameter of approximately 0.168 inches. I have found in this instance that the force necessary to pull the wire through this die is approximately 3,000 pounds. In reality it is a little over 3,000 pounds but the tension varies with the properties of the wire to a minor degree and to a much greater degree with the amount of lubrication and the condition of the surface of the wire being drawn through the die.

With continuing reference to FIG. 8, when a wire tensioning assembly is being utilized, a wire holder 222 is placed upon the platform and attached rigidly. The wire holder is then configured so that a die 220 of a given size is held in position. The end of the wire is then filed down to reduce the diameter and inserted into the die. On the outboard side of the die the wire then is connected to an existing wire on the tank and pulled through the die 220. In this manner the wire is tensioned.

It is also well known that the die will wear, and as the hole in the die gets larger, the required tensile force needed to pull the wire through the die is reduced.

Typically in prestressed tank operations it is desirable to start with a die that is of the size that will give approximately 7% greater tensile force than the designed tensile force in the wire. Then, as the wire tensioning operation continues, the hole in the die will wear and will become larger. This particular die is used until the tension in the wire becomes 7% below the desired tension, at which point the die is discarded.

In order to utilize this type of technology with the present invention, the die is sized so that the tension required to pull the wire through the die is slightly less than the 3,000 pound initial tension desired. The die gives the primary tension in the wire. A pretensioning assembly as previously described, involving either a hydraulically operated or an air operated arrangement, will be activated. In this manner the net tension in the wire $\mathbf{16}_T$ can be increased or decreased so that the desired position of the weight can be maintained by fine tuning the tension in the wire $\mathbf{16}_T$ through the operation of the pretensioning controls 37 and 38 described in connection with FIGS. 3 and 3*a*. In this instance, the die 220 is responsible for causing about 90% of the tension to exist in the wire $\mathbf{16}_T$, whereas the pretensioner 33 is responsible for bringing about the rest of the tension in the wire that is appropriate under the particular circumstances.

Also to be noted is the fact that the previously discussed slipbrake utilized on a turntable 22 can be employed in lieu of the wire tensioning assembly 33 for increasing relatively slightly, the tension in the wire $\mathbf{16}_T$ so as to obtain the desired wire tension and to keep the weight suspended at its proper operating position.

Turning now to FIGS. 9*a* and 9*b*, it has already been mentioned that various cable pulley configurations can be utilized in accordance with this invention, and in these two figures. I provide some examples. As will be recalled from FIG. 2, which represents the preferred arrangement, two wires $\mathbf{16}_T$ extend down from the pulley 41, and two cables 50 extend upwardly from the pulley 54. This provides a relationship in which the tension in the wire $\mathbf{16}_T$ equals the weight 40.

Another pulley configuration I have used but have found somewhat less desirable is depicted in FIG. 9*a*, where the weight is the equivalent of twice the tension in the wire $\mathbf{16}_T$.

A third pulley configuration that I have used is shown in FIG. 9*b*, wherein a mechanical advantage is obtained by the utilization of three cables operably associated with the pulley 54, with these of course providing an upward force on the pulley 54 that is opposed by the tension existing in the wire $\mathbf{16}_T$. In this instance the weight is two-thirds of the desired tension in the pulley.

In many of the examples I have set forth hereinbefore, a 3,000 pound weight has been utilized as a typical weight, this being appropriate for an 8 gauge wire, which is 0.162" in diameter. When a somewhat larger 6 gauge wire is being used, which is 0.192" in diameter, such wire is typically tensioned at 4,250 pounds.

As is known, the breaking strength of wire is 60% above the normal operating tension.

Reference is now made to FIG. 10, wherein I utilize a slip brake in conjunction with the wire roll 20, which wire roll is similar to that depicted in FIGS. 1, 2 and 7. It will be noted in FIG. 10 that in this embodiment of my invention I may utilize the wire roll 20 sitting upon a rotatable thimble 301, which consists of a hollow center shaft 302 and a flat plate 304. The flat plate 304 rests on the platform 24 and spins around a shaft 82 that is mounted to the platform 24. Connected underneath the thimble 301 is a slip brake 182, with it to be noted that the reference numerals of this figure are consistent with the reference numerals previously assigned to other components of my device.

It will be observed that the slip brake does not include a capstan and typically involves only one brake instead of a pair of brakes. It is also to be observed that the slip brake is in the form of a drum brake because by its very configuration, the brakes are kept clean, but in some instances I may prefer to utilize a disk brake.

Another way of achieving the same purpose as illustrated in FIG. 10 is to turn the wire roll 20 90° from the position shown, and to support the wire roll by the use of a horizontally disposed shaft, with the slip brake installed on that shaft. Although this may be successfully accomplished, it is to be noted that it is more time consuming to change rolls of wire and therefore I prefer the version illustrated in FIG. 10. It will be seen that in this illustrated embodiment, the lower end of shaft 282 is supported by a horizontally disposed member 84*a*, about which member the shaft rotates. A member similar to member 84*a* may be supported on the top side of the brake drum 90. The shaft 282 continues up through the upper member 84*a* where it extends upward into the wire reel 20, at which point it is connected to the thimble 301. The shaft 282 is concentric with shaft 302. The slip brake can function with either hydraulic pressure or pneumatic pressure applied to the cylinder 94.

It should now be clear that I have provided a highly effective wire wrapping machine utilizing a large weight maintained in suspension and capable of limited vertical movement, with the amount of tension in the wire being wrapped about the tank affecting the vertical positioning of the weight and being consistent with the mass of the weight.

It is important to note that in each of the embodiments of my invention, the weight is mounted for motion in a direction such that its position is influenced by gravity. The motion of the movably mounted weight serves in each embodiment as a reflection of the amount of tension in the wire and provides, during operation of the machine, a conspicuous indication, on a substantially continuous basis, of any changes in tension in the wire.

I claim:

1. A mobile wire wrapping machine adapted for wrapping wire under tension around a stationary, generally circular object of large size during substantially continuous travel of said machine around such object, said machine comprising means for providing a continuous supply of wire, said supply utilized in conjunction with a wire tensioning assembly through which the wire passes, said wire tensioning assembly serving to create a substantial amount of tension in the wire as it passes therethrough, and tension indicating means involving a weight suspended for motion in a direction such that its position is influenced by gravity, the position of said suspended, movably mounted weight serving as a reflection of the amount of tension in the wire and during operation of said machine, the motion of said weight provides a conspicuous indication, on a substantially continuous basis, of any changes in tension in the wire.

2. The mobile wire wrapping machine adapted for wrapping wire under tension around a stationary, generally circular object as recited in claim 1 in which said tension indicating means is utilized in connection with means operatively associated with said wire tensioning assembly, for modifying the tension in the wire, so that the wire being wrapped around the large stationary object will be maintained at a consistent tension.

3. The mobile wire wrapping machine adapted for wrapping wire under tension around a stationary, generally circular object as defined in claim 1 in which said movably mounted weight is suspended by a pulley arrangement.

4. The mobile wire wrapping machine adapted for wrapping wire under tension around a stationary, generally circular object as defined in claim 1 in which said suspended, movably mounted weight is mounted on a balance beam, with motion of said balance beam during operation of said machine being about a pivot point.

5. The mobile wire wrapping machine adapted for wrapping wire under tension around a stationary, generally circular object as defined in claim 4 in which the position of said weight on said balance beam can be adjusted, so as to bring about a change in the tension of the wire being wrapped around the object.

6. The mobile wire wrapping machine adapted for wrapping wire under tension around a stationary, generally circular object as defined in claim 5 in which the adjustments of said weight on said balance beam are accomplished by the use of screw means.

7. The mobile wire wrapping machine adapted for wrapping wire under tension around a stationary, generally circular object as recited in claim 1 in which said weight is utilized in conjunction with means for automatically modifying the tension in the wire, so that the wire being wrapped around the large stationary object is maintained at a consistent tension.

8. The mobile wire wrapping machine adapted for wrapping wire under tension around a stationary, generally circular object as defined in claim 1 in which said wire tensioning assembly serving to create a substantial amount of tension in the wire involves the use of a hydraulically powered mechanism.

9. The mobile wire wrapping machine adapted for wrapping wire under tension around a stationary, generally circular object as defined in claim 1 in which said wire tensioning assembly serving to create a substantial amount of tension in the wire involves the use of a pneumatically powered mechanism.

10. The mobile wire wrapping machine adapted for wrapping wire under tension around a stationary, generally circular object as defined in claim 1 in which a die stressing arrangement is employed to serve as said wire tensioning assembly.

11. The mobile wire wrapping machine adapted for wrapping wire under tension around a stationary, generally circular object as defined in claim 1 in which a pretensioning device is utilized in conjunction with said wire tensioning assembly.

12. The mobile wire wrapping machine adapted for wrapping wire under tension around a stationary, generally circular object as defined in claim 11 in which means are provided for controlling the amount of pretensioning of the wire by said pretensioning device, so that a selected amount of pretensioning can be accomplished.

13. A mobile wire wrapping machine adapted for wrapping wire under tension around a stationary, generally circular object of large size during substantially continuous travel of said machine around such object, said machine comprising means for providing a continuous supply of wire capable of continuously unrolling, said supply utilized in conjunction with a wire tensioning assembly through which the wire passes, said wire tensioning assembly utilizing a brake powered by a compressed fluid, enabling a substantial amount of tension to be created in the wire as it passes through said assembly, tension indicating means involving the use of a movably mounted weight suspended for motion in a direction such that its position is influenced by gravity, said tension indicating means provided by the use of said suspended, movably mounted weight, a conspicuous, substantially continuous indication of the tension existing in the wire to be wrapped around the large stationary object, said tension indicating means including an arrangement operatively interconnected with said brake, with the sensing of a change in tension in the wire causing a modification of the pressure applied by said brake, thus to bring about a consistent tension in the wire leaving the machine.

14. The mobile wire wrapping machine adapted for wrapping wire under tension around a stationary, generally circular object as defined in claim 13 in which said movably mounted weight is suspended by a pulley arrangement.

15. The mobile wire wrapping machine adapted for wrapping wire under tension around a stationary, generally circular object as defined in claim 13 in which said suspended, movably mounted weight is mounted on a balance beam, with motion of said balance beam during operation of said machine being about a pivot point.

16. The mobile wire wrapping machine adapted for wrapping wire under tension around a stationary, generally circular object as defined in claim 15 in which the position of said weight on said balance beam can be adjusted, so as to bring about a change in the tension of the wire being wrapped around the object.

17. The mobile wire wrapping machine adapted for wrapping wire under tension around a stationary, generally circular object as defined in claim 16 in which the adjustments of the weight on said balance beam are accomplished by the use of screw means.

18. The mobile wire wrapping machine adapted for wrapping wire under tension around a stationary, generally circular object as defined in claim 13 in which said wire tensioning assembly powered by a compressed fluid involves the use of a hydraulically powered mechanism.

19. The mobile wire wrapping machine adapted for wrapping wire under tension around a stationary, generally circular object as defined in claim 13 in which said wire tensioning assembly powered by a compressed fluid involves the use of a pneumatically powered mechanism.

20. The mobile wire wrapping machine adapted for wrapping wire under tension around a stationary, generally circular object as defined in claim 13 in which a pretensioning device is utilized in conjunction with said wire tensioning assembly.

21. The mobile wire wrapping machine adapted for wrapping wire under tension around a stationary, generally circular object as defined in claim 20 in which means are provided for controlling the amount of pretensioning of the wire by said pretensioning device, so that a selected amount of pretensioning can be accomplished.

22. A mobile wire wrapping machine adapted for wrapping wire under tension around a stationary, generally circular object of large size during substantially continuous travel of said machine around such object, said machine comprising means for providing a continuous supply of wire, said wire supply utilized in conjunction with a wire tensioning assembly, said wire tensioning assembly serving to create a substantial amount of tension in the wire as it passes therethrough, said wire tensioning assembly utilizing a brake arrangement powered by a pressurized fluid, capable of applying a selectively different amount of tension to the wire passing through said wire tensioning assembly, means for controlling the pressure of the pressurized fluid applied to said brake, and tension indicating means involving the use of a weight suspended for motion in a direction such that its position is influenced by gravity, the suspended position of said weight providing a conspicuous indication of tension in the wire, and the motion of said weight providing an indication of any change in tension of the wire, the modification of the pressure of the pressurized fluid in said brake arrangement as a consequence of a change in wire tension serving to automatically increase or decrease the braking force applied to the wire by the wire tensioning assembly as may be necessary to maintain a constant tension in the wire.

23. The mobile wire wrapping machine adapted for wrapping wire under tension around a stationary, generally circular object as defined in claim 22 in which said weight is suspended by a pulley arrangement.

24. The mobile wire wrapping machine adapted for wrapping wire under tension around a stationary, generally circular object as defined in claim 22 in which said suspended, movably mounted weight is mounted on a balance beam, with motion of said balance beam during operation of said machine being about a balance point.

25. The mobile wire wrapping machine adapted for wrapping wire under tension around a stationary, generally circular object as defined in claim 24 in which the position of said weight on said balance beam can be adjusted, so as to bring about a change in the tension of the wire being wrapped around the object.

26. The mobile wire wrapping machine adapted for wrapping wire under tension around a stationary, generally circular object as defined in claim 25 in which the adjustments of the weight on said balance beam are accomplished by the use of screw means.

27. The mobile wire wrapping machine adapted for wrapping wire under tension around a stationary, generally circular object as recited in claim 22 in which said tension indicating means is utilized in an operative relationship with means for automatically modifying the tension in the wire, so that the wire being wrapped around the large stationary object is maintained at a consistent tension.

28. The mobile wire wrapping machine adapted for wrapping wire under tension around a stationary, generally circular object as recited in claim 22 in which means are provided for sensing any changes in the position of said weight that represent a change in the tension of the wire, and means for sending information relating to such change to said wire tensioning assembly, to bring about the restoration of a desired tension in the wire.

29. The mobile wire wrapping machine adapted for wrapping wire under tension around a stationary, generally circular object as recited in claim 22 in which a pair of limit switches mounted in a spaced relationship in an operative association with said weight define the travel extremes of said weight, said weight normally being maintained in a position approximately midway between said limit switches, with the contacting of one or the other of said limit switches as a result of a repositioning of said weight automatically bringing about a change in the operation of said wire tensioning assembly, such that said weight will be caused to return to a position between the limit switches as a consequence of the modification of tension in the wire.

* * * * *